US011367556B2

(12) United States Patent
Tonogai et al.

(10) Patent No.: US 11,367,556 B2
(45) Date of Patent: Jun. 21, 2022

(54) COIL DEVICE

(71) Applicant: TDK CORPORATION, Tokyo (JP)

(72) Inventors: Toru Tonogai, Tokyo (JP); Atsuyuki Nakano, Tokyo (JP); Terumasa Toyoda, Tokyo (JP); Yuichi Oyanagi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 469 days.

(21) Appl. No.: 16/294,381

(22) Filed: Mar. 6, 2019

(65) Prior Publication Data

US 2019/0304659 A1 Oct. 3, 2019

(30) Foreign Application Priority Data

Mar. 29, 2018 (JP) ..... JP2018-065884
Feb. 8, 2019 (JP) ..... JP2019-021868

(51) Int. Cl.
*H01F 27/24* (2006.01)
*H01F 27/29* (2006.01)
*H01F 27/28* (2006.01)

(52) U.S. Cl.
CPC ..... *H01F 27/24* (2013.01); *H01F 27/2823* (2013.01); *H01F 27/29* (2013.01)

(58) Field of Classification Search
CPC ..... H01F 27/24; H01F 27/29; H01F 27/2823; H01F 3/10; H01F 2017/048; H01F 2003/106; H01F 17/04; H01F 27/292; H01F 1/20; H01F 27/306; H01F 3/02; H01F 3/08
See application file for complete search history.

(56) References Cited

U.S. PATENT DOCUMENTS 8,723,629 B1 * 5/2014 Liu ..... H01F 1/14741 336/83
9,711,270 B2 * 7/2017 Marusawa ..... H01F 27/255
9,786,424 B2 * 10/2017 Park ..... H01F 17/0013
9,814,167 B2 * 11/2017 Park ..... H01F 17/0033
2010/0157565 A1 * 6/2010 Yoshida ..... H01F 27/292 361/811
2014/0176283 A1 * 6/2014 Yang ..... H01F 17/0033 336/200
2018/0308620 A1 * 10/2018 Shinohara ..... H01F 17/045
2019/0013133 A1 * 1/2019 Sasaki ..... H01F 27/292

FOREIGN PATENT DOCUMENTS

JP 2003-168610 A 6/2003
JP 2012119374 A * 6/2012

* cited by examiner

*Primary Examiner* — Mang Tin Bik Lian
(74) *Attorney, Agent, or Firm* — Oliff PLC

(57) ABSTRACT

An inductor has a coil portion made of a wire wound in a coil shape and an element body in which the coil portion is provided. The element body has a first core member, a second core member, and a third core member. The first core member has a winding core portion configured to be positioned inside the coil portion. The second core member is accommodated in the winding core portion. The third core member covers the coil portion and the first core member in which the second core member is accommodated in the winding core portion.

9 Claims, 14 Drawing Sheets

COIL DEVICE

BACKGROUND OF THE INVENTION

1. Field of the Invention

The present invention relates to a coil device.

2. Description of the Related Art

JP 2003-168610 A discloses a coil device in which a second magnetic material is disposed inside an air core coil and the second magnetic material is embedded in a first magnetic material. In the coil device disclosed in JP 2003-168610 A, a magnetic material higher in magnetic permeability than the first magnetic material is used as the second magnetic material, and thus the effective magnetic permeability of the coil device is increased.

In the coil device disclosed in JP 2003-168610 A, the position of the second magnetic material or the like may deviate, short circuit defects may result from contact between the second magnetic material and the coil, and magnetic property deterioration may arise in the form of inductance value deterioration or the like.

Patent Document 1: JP2003-168610 (A)

SUMMARY OF THE INVENTION

The invention has been made in view of such circumstances, and an object of the invention is to provide a coil device excellent in magnetic properties.

In order to achieve the above object, a coil device according to the invention includes a coil portion made of a wire wound in a coil shape and an element body having the coil portion in the element body. The element body includes a first core member having a winding core portion configured to be positioned inside the coil portion, a second core member accommodated in the winding core portion, and a third core member covering the coil portion and the first core member in which the second core member is accommodated in the winding core portion.

With the coil device according to the invention, the effective magnetic permeability of the element body can be increased as, for example, a high-magnetic permeability material such as a metallic magnetic material constitutes the second core member. In addition, the first core member and the third core member can be constituted by a rust-resistant magnetic material as the second core member can be constituted by a high-magnetic permeability metallic magnetic material or the like.

In the coil device according to the invention, the second core member is accommodated in the winding core portion of the first core member, and thus the second core member is separated from the coil portion and the second core member is fixed to the first core member and positioned. Accordingly, contact between the coil portion and the second core member, which is constituted by a metallic magnetic material or the like, becomes less likely and short circuit defects can be prevented. In addition, the position of the second core member is unlikely to deviate, the second core member is unlikely to be exposed to the outside of the element body, and it is possible to prevent rusting of the surface of the second core member constituted by a metallic magnetic material or the like.

As described above, with the invention, it is possible to increase the effective magnetic permeability of the element body while preventing short circuit defects and rust generation. As a result, it is possible to provide the coil device that is excellent in inductance value and other magnetic properties.

In the coil device according to the invention, the three core members constitute the element body. The three core members are the first core member, the second core member, and the third core member. Accordingly, it is possible to control the magnetic properties of the coil device with ease and it is possible to constitute the coil device that has various magnetic properties by appropriately selecting the materials constituting the core members.

Preferably, the winding core portion has a recessed portion so that the second core member is accommodated in the recessed portion. As a result of this configuration, the second core member is accommodated in the recessed portion and the second core member is fixed with ease to the first core member. Accordingly, it is possible to prevent a positional deviation of the second core member and effectively enhance the magnetic properties of the coil device.

The second core member may be accommodated in the recessed portion such that a part of the second core member protrudes outward from the recessed portion or a step is formed in the recessed portion. As a result of this configuration, an increase in contact area is achieved among the first core member, the second core member, and the third core member and the bondability of each core member is improved. Accordingly, the first core member, the second core member, and the third core member can be firmly coupled, and it is possible to prevent peeling of the second core member from the third core member and effectively enhance the magnetic properties of the coil device.

Preferably, an outer peripheral surface of the winding core portion is a tapered surface with a diameter decreasing in a direction away from a bottom surface of the element body. As a result of this configuration, the surface area of the outer peripheral surface of the winding core portion becomes larger than in a case where, for example, the winding core portion has a cylindrical shape, and the contact area between the winding core portion (first core member) and the third core member increases. Accordingly, the first core member and the third core member can be firmly coupled, and it is possible to prevent peeling of the third core member from the first core member and effectively enhance the magnetic properties of the coil device.

When the air core coil-based coil portion is attached to the winding core portion of the first core member, the coil portion can be easily fitted from the distal end portion of the winding core portion toward the proximal end portion of the winding core portion. Accordingly, attachment of the coil portion can be performed with ease during manufacturing of the coil device.

Preferably, the first core member has a support portion having a surface on which the winding core portion is formed and the coil portion is installed on the support portion. As a result of this configuration, the coil portion is fixed to the first core member and positioned, and the position of the coil portion is unlikely to deviate. In addition, it is possible to prevent deformation of the coil portion when the third core member covers the first core member in which the second core member is accommodated in the winding core portion. As a result of this configuration, it is possible to enhance the magnetic properties of the coil device by preventing a positional deviation, deformation, and so on of the coil portion.

At least one of the first core member, the second core member, and the third core member may contain a magnetic material. As a result of this configuration, it is possible to control the inductance value and the other magnetic properties of the element body in accordance with the type of the magnetic material.

In order to achieve the above object, a coil device manufacturing method according to the invention includes a step of disposing a first core member having a winding core portion, a step of accommodating a second core member in the winding core portion, a step of attaching a coil portion made of a wire wound in a coil shape to the winding core portion, and a step of covering the first core member with the coil portion by using a third core member with the second core member accommodated in the winding core portion.

By the manufacturing method according to the invention, it is possible to easily form the coil device of the invention that has the first core member having the winding core portion, the second core member accommodated in the winding core portion, and the third core member covering the first core member with the coil portion. Accordingly, with the invention, it is possible to increase the effective magnetic permeability of the element body while preventing short circuit defects and rust generation. As a result, it is possible to provide the coil device that is excellent in inductance value and other magnetic properties.

DETAILED DESCRIPTION OF THE PREFERRED EMBODIMENTS

Hereinafter, the invention will be described based on embodiments illustrated in accompanying drawings.

First Embodiment

Figure 1A:
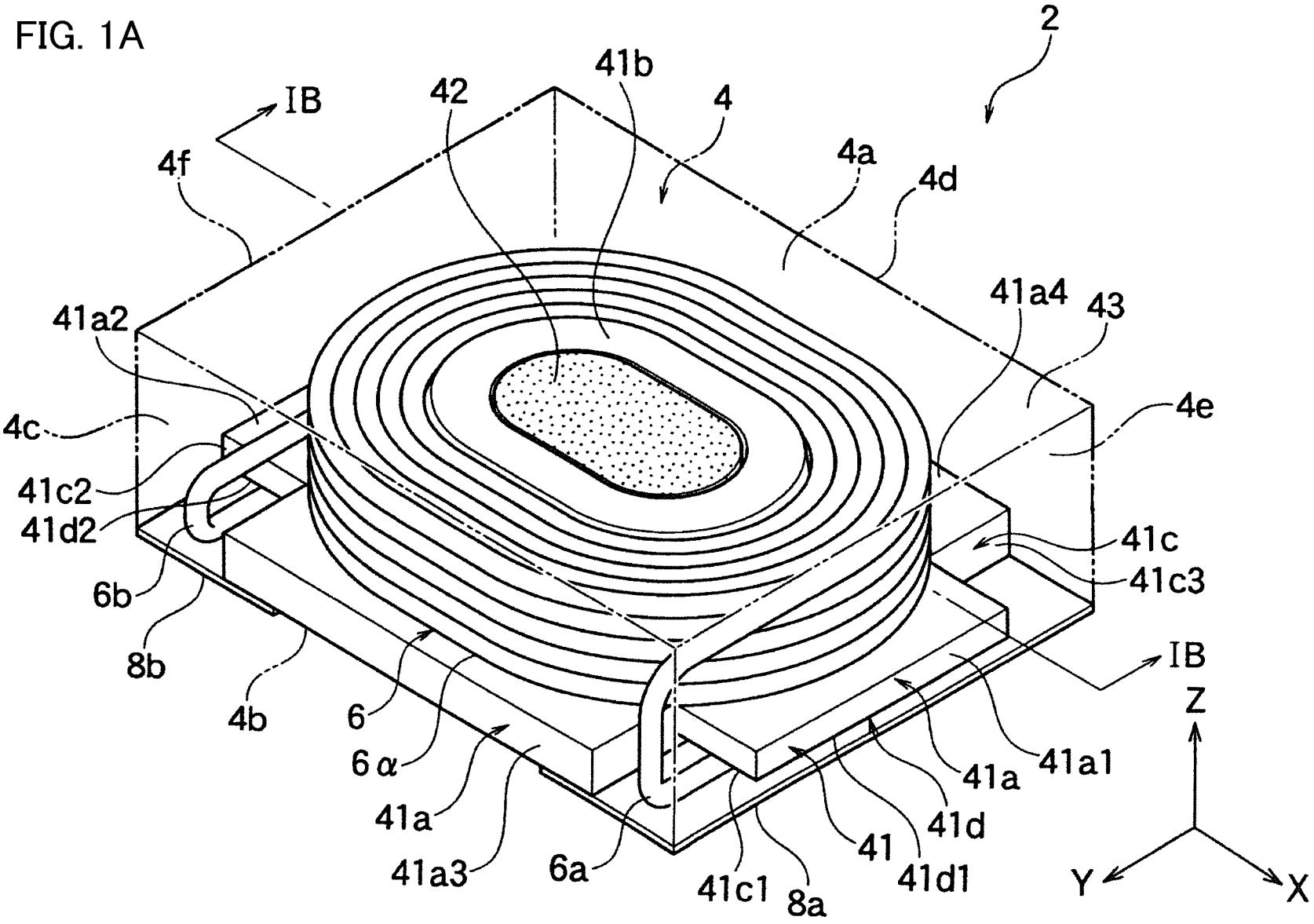
FIG. 1A is a perspective view of a coil device according to a first embodiment of the invention.

As illustrated in FIG. 1A, an inductor 2 as a coil device (chip component) according to a first embodiment of the invention has an element body 4 that has a substantially rectangular parallelepiped shape (that is substantially hexahedral). It should be noted that the coil device according to the invention is not limited to the inductor 2 and may be another coil device.

The element body 4 has an upper surface 4*a*, a bottom surface (main surface to be a mounting surface) 4*b* on the side that is opposite in a Z-axis direction to the upper surface 4*a*, and four side surfaces 4*c* to 4*f* Although the dimensions of the element body 4 are not particularly limited, the longitudinal (X-axis) dimension of the element body 4 is preferably 1.2 to 6.5 mm, the lateral (Y-axis) dimension of the element body 4 is preferably 0.6 to 6.5 mm, and the height (Z-axis) dimension of the element body 4 is preferably 0.5 to 5.0 mm as an example.

A wire 6 is provided in the element body 4. The wire 6 is a conductor wound in a coil shape. In the present embodiment, the wire 6 is constituted by a round wire made of a copper wire covered with an insulating coating or the like. An epoxy modified acrylic resin or the like is used as the insulating coating. In the element body 4, the wire 6 is wound in a coil shape in the form of at least one roll (a 5×5 roll in the illustrated example) and constitutes a coil portion 6α.

Although an air core coil wound by a general normalwise constitutes the coil portion 6α in the present embodiment, the air core coil may be replaced with an air core coil in which the wire 6 is wound by α winding or an air core coil in which the wire 6 is wound by an edgewise. A first lead portion 6*a* is formed at one end of the wire 6 and a second lead portion 6*b* is formed at the other end of the wire 6.

Figure 1B:
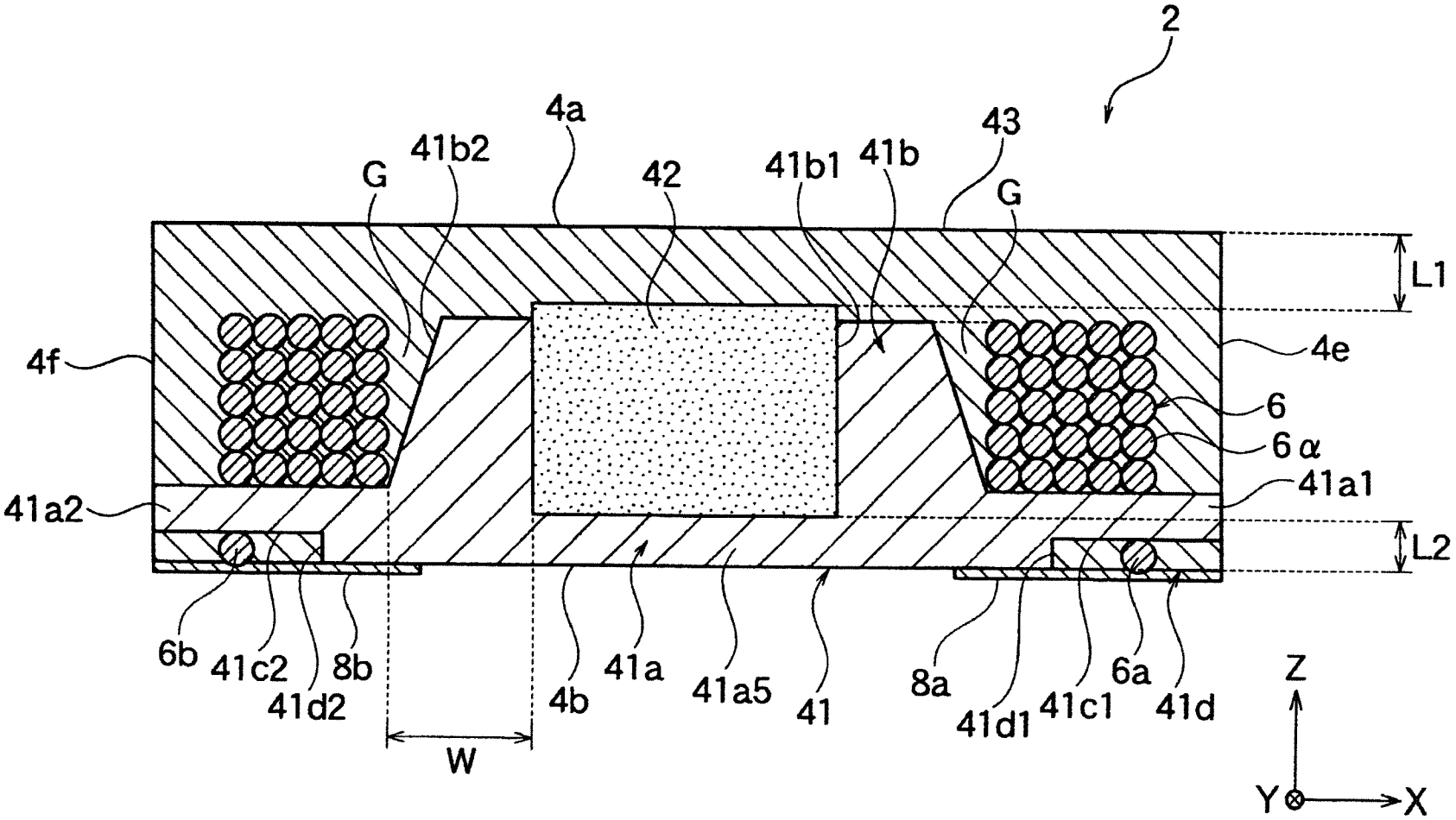
FIG. 1B is a cross-sectional view of the coil device taken along line IB-IB in FIG. 1A.

As illustrated in FIGS. 1A and 1B, the element body 4 in the present embodiment has a first core member 41, a second core member 42, and a third core member 43. The element body 4 is configured by the three core members 41, 42, and 43 being combined.

As illustrated in FIG. 1A, the first core member 41 has a support portion 41*a*, a winding core portion 41*b*, a notch portion 41*c*, and a step portion 41*d*. The support portion 41*a* is provided with a first flange portion 41*a*1 protruding to the side surface 4*e* side of the element body 4 along the X-axis direction, a second flange portion 41*a*2 protruding to the side surface 4*f* side of the element body 4 along the X-axis direction, a third flange portion 41*a*3 protruding to the side surface 4*c* side of the element body 4 along the Y-axis direction, and a fourth flange portion 41*a*4 protruding to the side surface 4*d* side of the element body 4 along the Y-axis direction.

As illustrated in FIG. 1B, the support portion 41*a* has a main body portion 41*a*5. The main body portion 41*a*5 is formed in a substantially central portion of the support portion 41*a* and is a part surrounded by the first flange portion 41*a*1 to the fourth flange portion 41*a*4.

As illustrated in FIGS. 1A and 1B, the coil portion 6α can be installed (fixed) in the first flange portion 41*a*1 to the fourth flange portion 41*a*4 and the main body portion 41*a*5 such that the lower end portion of the coil portion 6α and the Z-axis upper surface of the support portion 41*a* are in contact with each other. The flange portions 41*a*1 and 41*a*2 are formed so as to be thinner than the flange portions 41*a*3 and 41*a*4.

The winding core portion 41*b* is formed on the Z-axis upper surface of the support portion 41*a* and is formed integrally with the support portion 41*a* (main body portion 41*a*5 to be more specific). The winding core portion 41*b* has a shape (projecting portion) protruding upward and is inserted inside the coil portion 6α disposed on the support portion 41*a*. In other words, the winding core portion 41*b* is configured to be positioned inside the coil portion 6α. In the present embodiment, the coil portion 6α where the wire 6 is wound in advance is fixed to the winding core portion 41*b*. Alternatively, the coil portion 6α may be fixed to the winding core portion 41*b* by the wire 6 being wound around the winding core portion 41*b*.

As illustrated in FIG. 1B, in the present embodiment, an outer peripheral surface 41*b*2 of the winding core portion 41*b* is a tapered surface with a diameter decreasing in a direction away from the bottom surface of the element body 4 (the direction from the bottom surface 4*b* toward the upper surface 4*a*). Accordingly, when the coil portion 6*a* is installed on the winding core portion 41*b*, a gap G having a substantially triangular shape in cross section is formed between the outer peripheral surface of the winding core portion 41*b* and the inner peripheral surface of the coil portion 6α, and the gap G is filled with the third core member 43.

Accordingly, when the coil portion 6α is installed on the winding core portion 41*b*, the coil portion 6α is sandwiched by the third core member 43 on the inner peripheral side of the coil portion 6α and the third core member 43 on the outer peripheral side of the coil portion 6α in the layer near the substantial center of the element body 4 in the Z-axis direction.

In the present embodiment, the winding core portion 41*b* has a recessed portion 41*b*1 so that the second core member 42 is accommodated in the recessed portion 41*b*1 and is capable of accommodating the second core member 42 in the recessed portion 41*b*1 (winding core portion 41*b*). The recessed portion 41*b*1 is formed such that the depth of the recessed portion 41*b*1 is smaller than the height of the second core member 42. Accordingly, a part of the second core member 42 protrudes outward from the recessed portion 41*b*1 once the second core member 42 is accommodated in the recessed portion 41*b*1. In other words, the upper end of the winding core portion 41*b* and the upper end of the second core member 42 are not flush with each other and a step portion is formed. It should be noted that the depth of the recessed portion 41*b*1 is set such that the second core member 42 does not project from the upper surface 4*a* of the element body 4 when the second core member 42 is accommodated in the recessed portion 41*b*1.

A width W between the outer and inner peripheral surfaces of the winding core portion 41*b* (the thickness of the tubular winding core portion 41*b*) is preferably 0.1 to 10 mm and more preferably 0.1 to 6 mm. By setting the thickness W within the predetermined range, it is possible to ensure a sufficient insulation distance between the coil portion 6α and the second core member 42 accommodated in the recessed portion 41*b*1. In addition, a sufficient X-axis-direction width (or Y-axis-direction width) can be ensured for the recessed portion 41*b*1 and a sufficient volume can be ensured for the recessed portion 41*b*1. As a result, the second core member 42 can be accommodated in the recessed portion 41*b*1 with a sufficient X-axis-direction width (or Y-axis-direction width).

A length L1 from the upper end of the second core member 42 to the upper surface 4*a* of the element body 4 is preferably 0.03 to 10 mm and more preferably 0.06 to 6 mm. A length L2 from the lower end of the second core member 42 to the bottom surface 4*b* of the element body 4 is preferably 0.03 to 10 mm and more preferably 0.06 to 6 mm.

By setting the lengths L1 and L2 within the predetermined range, it is possible to ensure a sufficient Z-axis-direction height for the recessed portion 41*b*1 and ensure a sufficient volume for the recessed portion 41*b*1. As a result, the second core member 42 can be accommodated in the recessed portion 41*b*1 with a sufficient Z-axis-direction height. It should be noted that the length L2 may exceed the length L1 although the length L1 exceeds the length L2 in the illustrated example. With such a configuration, exposure of the second core member 42 to the outside of the element body 4 can be effectively prevented. Alternatively, the length L1 and the length L2 may be equal to each other.

As illustrated in FIG. 1A, the notch portion 41*c* is formed in the first core member 41. The notch portion 41*c* has a first notch portion 41*c*1 formed near the intersection of the side surface 4*c* and the side surface 4*e* of the element body 4, a second notch portion 41*c*2 formed near the intersection of the side surface 4*c* and the side surface 4*f* of the element body 4, a third notch portion 41*c*3 formed near the intersection of the side surface 4*d* and the side surface 4*e* of the element body 4, and a fourth notch portion (not illustrated) formed near the intersection of the side surface 4*d* and the side surface 4*f* of the element body 4. In the illustrated example, all of the notch portions are notched in a substantially tetragonal shape. Alternatively, the notch portions 41*c*1 to 41*c*4 may be notched in another shape or the notch portions 41*c*1 to 41*c*4 may be through holes penetrating a surface and a back surface.

In the present embodiment, the lead portions 6*a* and 6*b* drawn out from the coil portion 6α pass through the first notch portion 41*c*1 and the second notch portion 41*c*2. In other words, the first notch portion 41*c*1 and the second notch portion 41*c*2 are used mainly as passages for passage of the lead portions 6*a* and 6*b*. In addition, the first notch portion 41*c*1 and the second notch portion 41*c*2 function as passages, along with the other notch portions, at a time when a molding material constituting the third core member 43 flows from the surface of the first core member 41 to the back surface of the first core member 41 as described later.

The step portion 41*d* is formed on the bottom surface of the support portion 41*a* positioned on the side that is opposite to the surface supporting the coil portion 6α, that is, the bottom surface of the first core member 41. The step portion 41*d* has a first step portion 41*d*1 formed on the side surface 4*e* side of the element body 4 and a second step portion 41*d*2 formed on the side surface 4*f* side of the element body 4. The first step portion 41*d*1 is formed below the first flange portion 41*a*1 and the second step portion 41*d*2 is formed below the second flange portion 41*a*2. As described above, the flange portions 41*a*1 and 41*a*2 are formed so as to be thinner than the flange portions 41*a*3 and 41*a*4, and thus the step portions 41*d*1 and 41*d*2 are formed below the flange portions 41*a*1 and 41*a*2 in the Z-axis direction.

The step portions 41*d*1 and 41*d*2 are formed along the Y-axis direction in the flange portions 41*a*1 and 41*a*2. In the illustrated example, the X-axis-direction width of the step portions 41*d*1 and 41*d*2 is approximately three to five times the diameter of wires 6*a* and 6*b*.

As illustrated in FIG. 1B, the outer diameter of the lead portions 6*a* and 6*b* exceeds the step height of the step portions 41*d*1 and 41*d*2. Accordingly, once the lead portions 6*a* and 6*b* of the coil portion 6α are disposed in the step portions 41*d*1 and 41*d*2, the outer peripheries of the lead portions 6*a* and 6*b* are partially accommodated inside the step portions 41*d*1 and 41*d*2 and the rest of the outer peripheries protrude to the outside of the step portions 41*d*1 and 41*d*2 and are positioned below the bottom surface of the main body portion 41*a*5 (support portion 41*a*). It should be noted that the lead portions 6*a* and 6*b* are disposed in the step portions 41*d*1 and 41*d*2 in a state where the outer peripheral surfaces of the lead portions 6*a* and 6*b* partially abut against the lower surfaces of the flange portions 41*a*1 and 41*a*2.

As illustrated in FIG. 1A, the lead portions 6*a* and 6*b* drawn out from the coil portion 6α extend along the Y-axis direction substantially in parallel to each other and are drawn out to the vicinity of the side surface 4*c* of the element body 4. In addition, the lead portions 6*a* and 6*b* are bent in the Z-axis direction in the vicinity of the side surface 4*c* of the element body 4 and are drawn out to the vicinity of the bottom surface 4*b* of the element body 4. Then, the lead portions 6*a* and 6*b* are bent in the Y-axis direction after passing through the notch portions 41*c*1 and 41*c*2 in the vicinity of the bottom surface 4*b* of the element body 4, extend along the step portions 41*d*1 and 41*d*2, and are drawn out to the Y-axis-direction end portions of the step portions 41*d*1 and 41*d*2 that are on the side surface 4*d* side.

Once the lead portions 6*a* and 6*b* of the coil portion 6α pass through the notch portions 41*c*1 and 41*c*2 as described above, the lead portions 6*a* and 6*b* are drawn out into the step portions 41*d*1 and 41*d*2 on the lower surfaces of the flange portions 41*a*1 and 41*a*2 in the direction that is opposite to the direction in which the lead portions 6*a* and 6*b* are drawn out from the coil portion 6α (reversed by approximately 180°) on the support portion 41*a*.

Although the second core member 42 illustrated in FIG. 1A has a substantially elliptical columnar shape, the shape of the second core member 42 is not particularly limited. For example, the second core member 42 may be circular, tetragonal, rectangular, or the like when viewed from the Z-axis direction. As illustrated in FIG. 1B, the second core member 42 is accommodated in the recessed portion 41*b*1 such that the outer peripheral surface of the second core member 42 abuts against the inner peripheral surface of the recessed portion 41*b*1. Alternatively, a slight gap may be formed between the outer peripheral surface of the second core member 42 and the inner peripheral surface of the recessed portion 41*b*1.

The periphery of the second core member 42 is covered with the winding core portion 41*b* of the first core member 41 and indirectly covered with the third core member 43. As a result, the second core member 42 is doubly shielded by the first core member 41 and the third core member 43.

The third core member 43 covers the coil portion 6α and the first core member 41 in which the second core member 42 is accommodated in the winding core portion 41*b*. Accordingly, the coil portion 6α is sandwiched by the third core member 43 disposed above the coil portion 6α and the first core member 41 disposed below the coil portion 6α.

The third core member 43 covers the upper part of the support portion 41*a*, and the notch portion 41*c* and the step portions 41*d*1 and 41*d*2 are filled with the third core member 43. It should be noted that the third core member 43 does not cover the bottom surface 4*b* of the support portion 41*a*.

The step portions 41*d*1 and 41*d*2 are filled with the third core member 43 such that the third core member 43 is substantially flush with the bottom surface of the main body portion 41*a*5 (support portion 41*a*). Accordingly, in the present embodiment, the lead portions 6*a* and 6*b* of the coil portion 6α partially protrude from the bottom surface 4*b* of the third core member 43.

Accordingly, in the present embodiment, the outer peripheral surfaces of the lead portions 6*a* and 6*b* have portions exposed as exposed portions from the bottom surface of the third core member 43 of the element body 4, and the rest of the outer peripheral surfaces are embedded as embedded portions in the third core member 43 of the element body 4.

In the layer near the substantial center of the element body 4 in the Z-axis direction, the second core member 42 is disposed on the innermost side along the X (or Y) axis, the winding core portion 41*b* of the first core member 41 is disposed outside the second core member 42, and the third core member 43 is disposed outside the winding core portion 41*b*. Accordingly, in the layer near the substantial center of the element body 4 in the Z-axis direction, the third core member 43, the first core member 41, the second core member 42, the first core member 41, and the third core member 43 are disposed in this order from one X-axis side toward the other X-axis side (or from one Y-axis side toward the other Y-axis side).

It is preferable that the first core member 41 and the third core member 43 of the element body 4 contain a magnetic material and a synthetic resin or the like. Examples of the magnetic material include ferrite particles and metallic magnetic material particles. Examples of the ferrite particles include Ni—Zn-based ferrite and Mn—Zn-based ferrite. The metallic magnetic material particles are not particularly limited. Examples of the metallic magnetic material particles include Fe—Ni alloy powder, Fe—Si alloy powder, Fe—Si—Cr alloy powder, Fe—Co alloy powder, Fe—Si—Al alloy powder, and amorphous iron.

The synthetic resin or the like is not particularly limited. Examples of the synthetic resin or the like include an epoxy resin, a phenol resin, a polyester resin, a polyurethane resin, a polyimide resin, another synthetic resin, and another nonmagnetic material. It should be noted that the third core member 43 preferably contains a large amount of resin from the viewpoint of improving moldability.

In the present embodiment, it is preferable that the material that constitutes the first core member 41, the material that constitutes the second core member 42, and the material that constitutes the third core member 43 are selected such that μ2 exceeds μ1 and μ2 exceeds μ3 when the relative magnetic permeability of the first core member 41 is μ1, the relative magnetic permeability of the second core member 42 is μ2, and the relative magnetic permeability of the third core member 43 is μ3. μ1 and μ3 may be equal to or differ from each other.

The relative magnetic permeability μ1 of the first core member 41 is not particularly limited and is, for example, 1 to 20,000. The material that constitutes the second core member 42 is higher in relative magnetic permeability than the material that constitutes the first core member 41. For example, a columnar body made of a metallic magnetic material, a sintered body of a metallic magnetic material containing no resin, or a resin-containing metallic magnetic material constitutes the second core member 42. It should be noted that no insulating coating needs to be applied to the metallic magnetic powder that is contained in the second core member 42. It is preferable that an insulating coating is applied to the metal magnetic powder that constitutes the first core member 41 and the third core member 43.

Figure 1C:
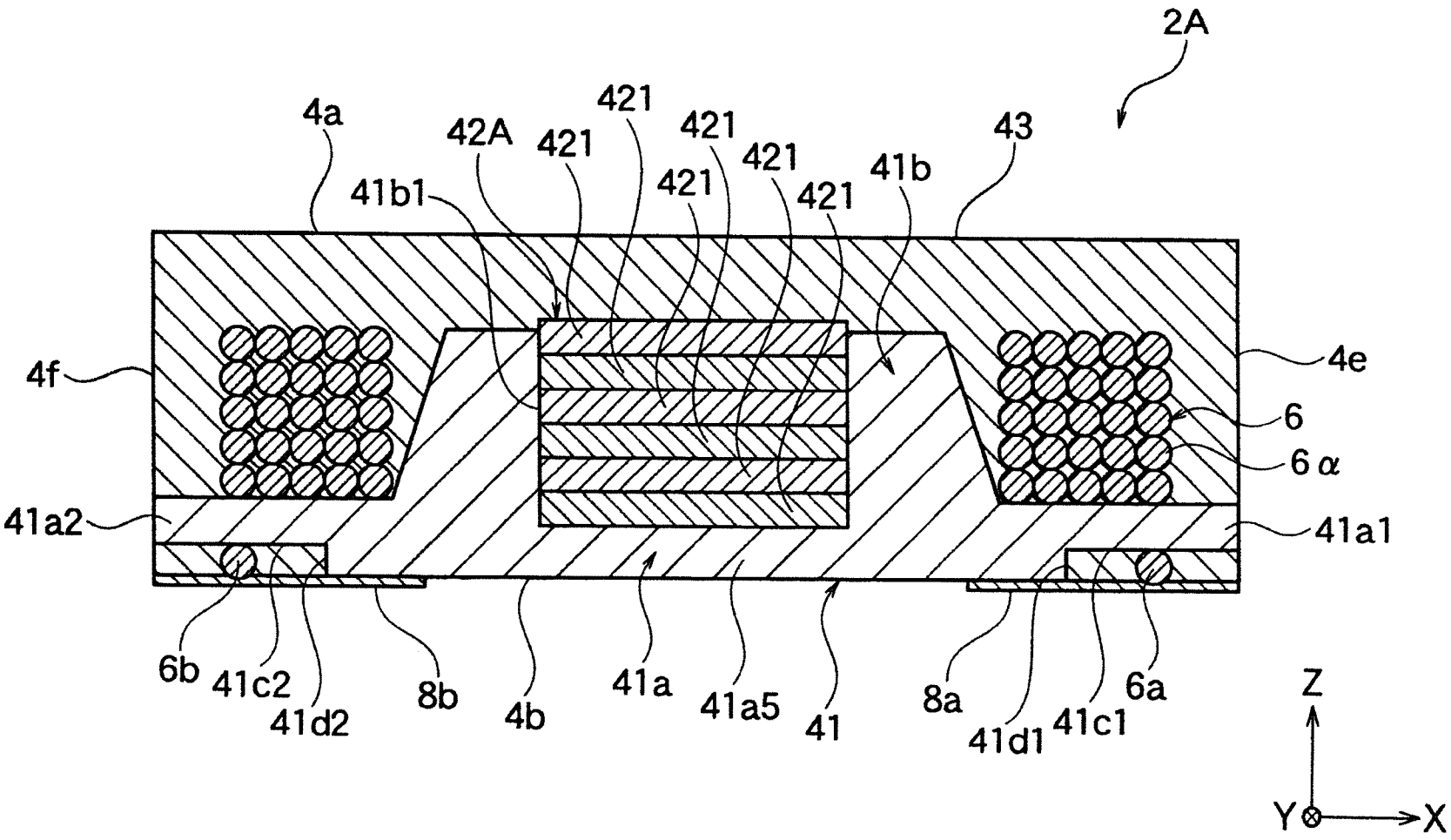
FIG. 1C is a cross-sectional view illustrating a coil device according to a second embodiment of the invention.
Figure 1D:
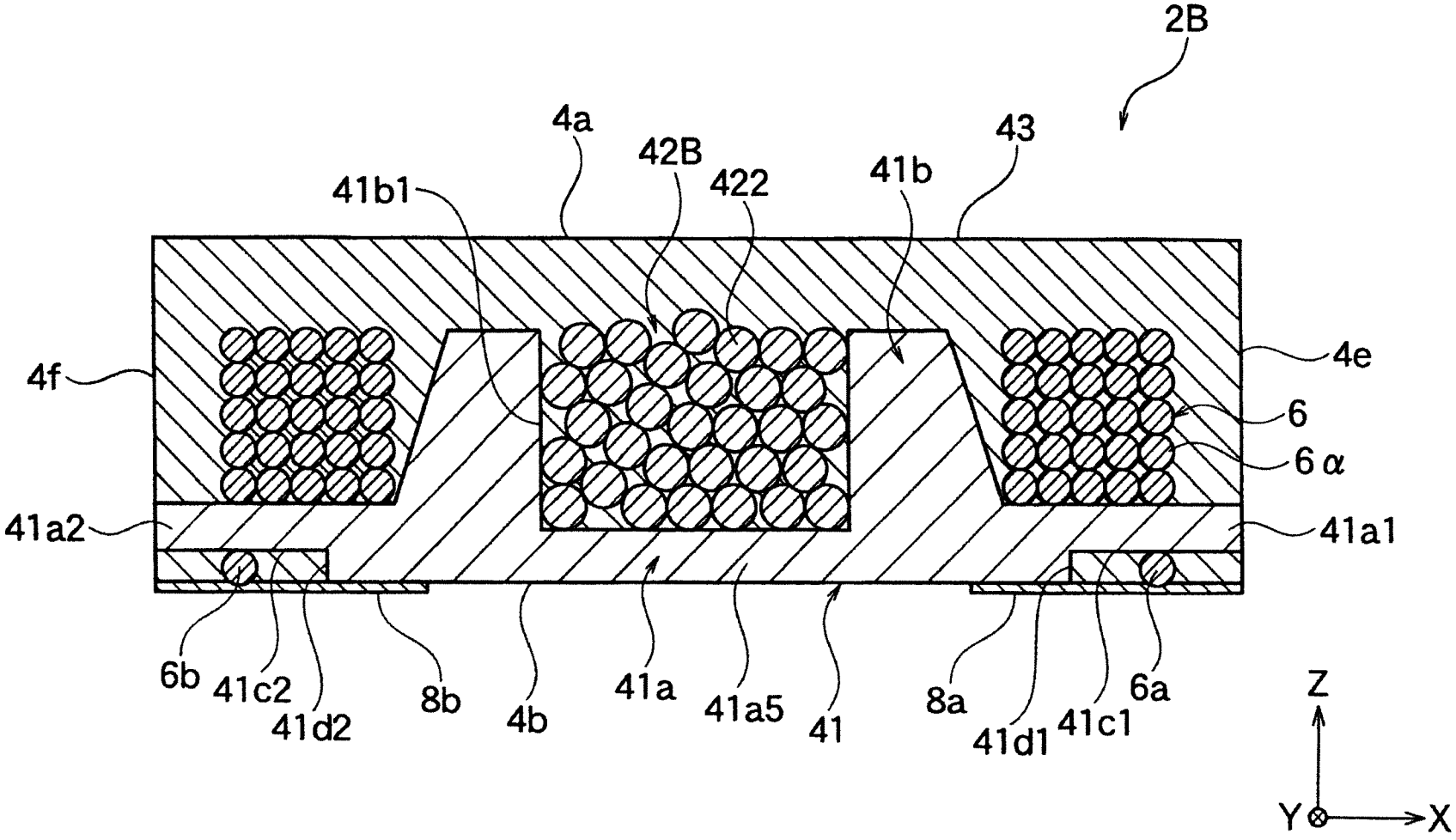
FIG. 1D is a cross-sectional view illustrating a coil device according to a third embodiment of the invention.
Figure 1E:
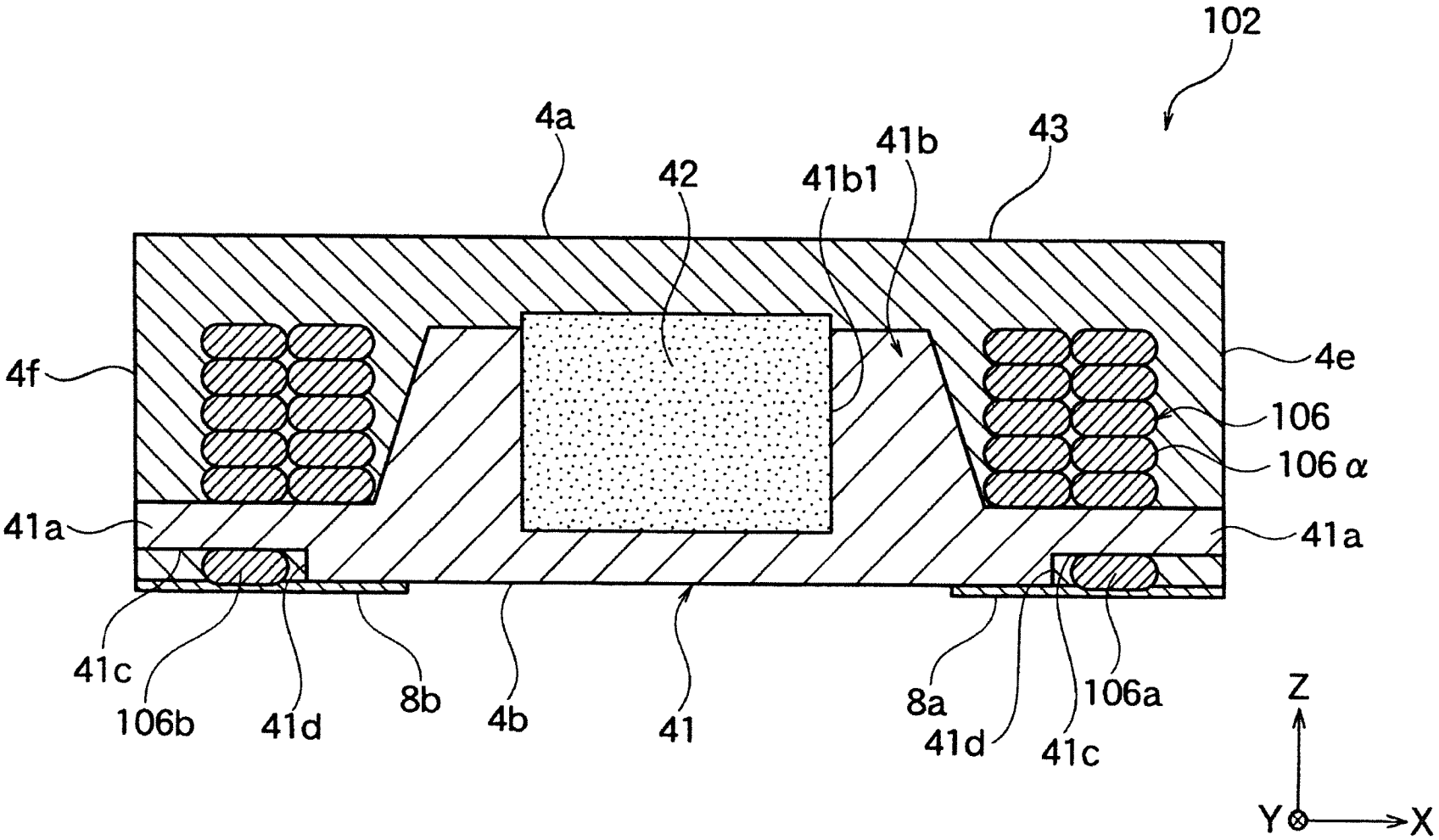
FIG. 1E is a cross-sectional view illustrating a modification example of the coil device illustrated in FIG. 1B.
Figure 1F:
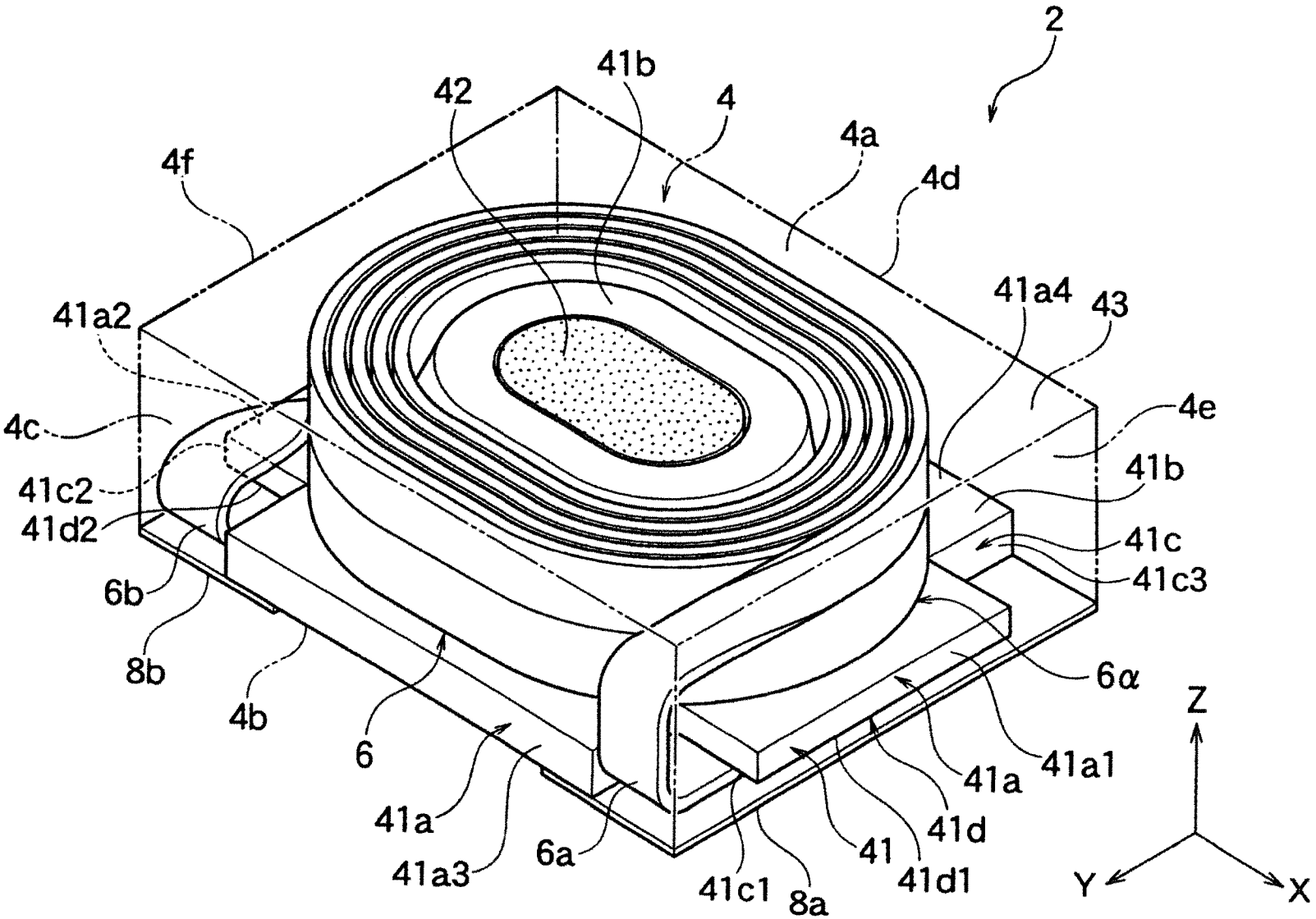
FIG. 1F is a perspective view illustrating a modification example of the coil device illustrated in FIG. 1E.
Figure 1G:
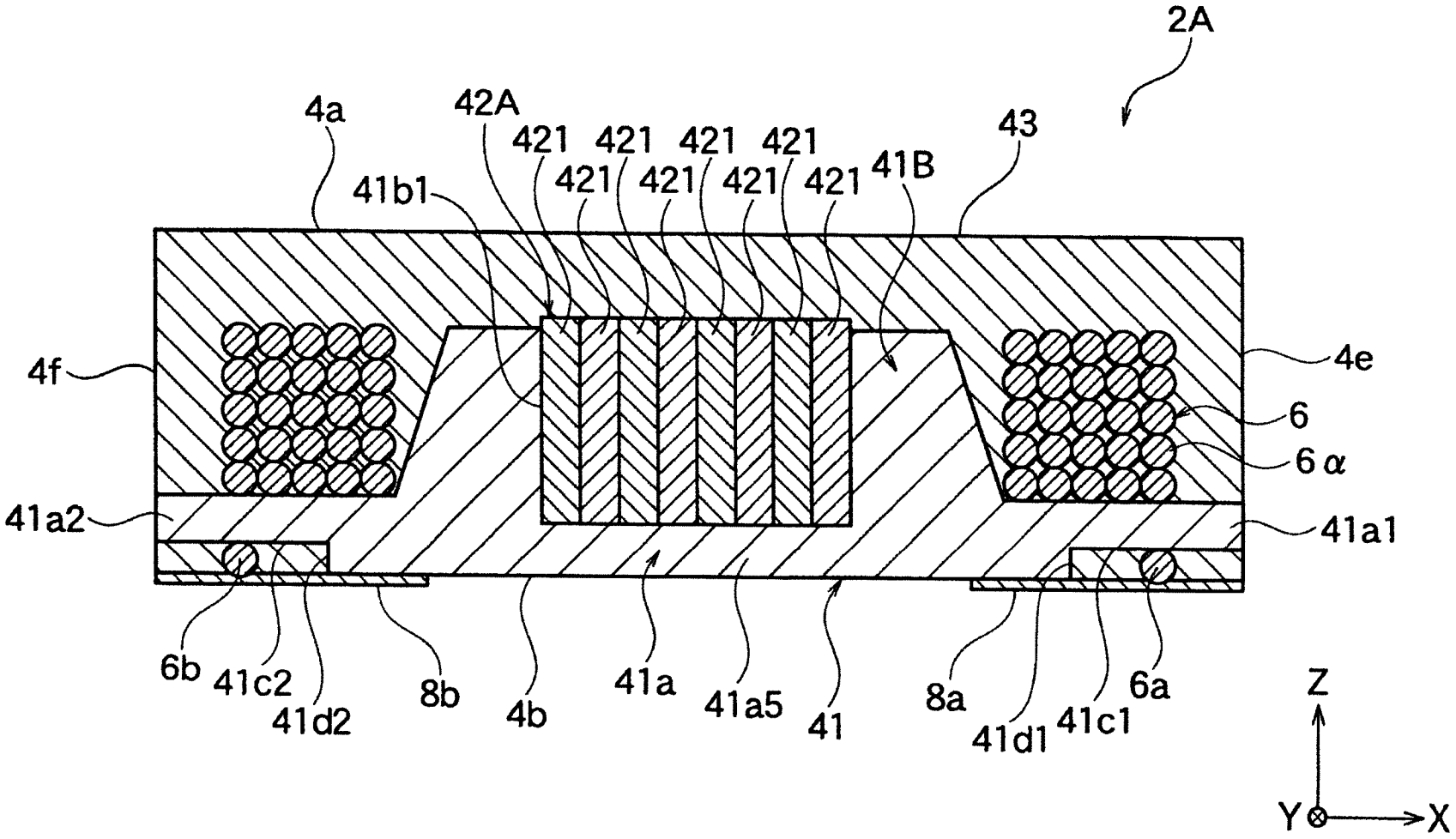
FIG. 1G is a cross-sectional view illustrating a modification example of the coil device illustrated in FIG. 1C.
Figure 1H:
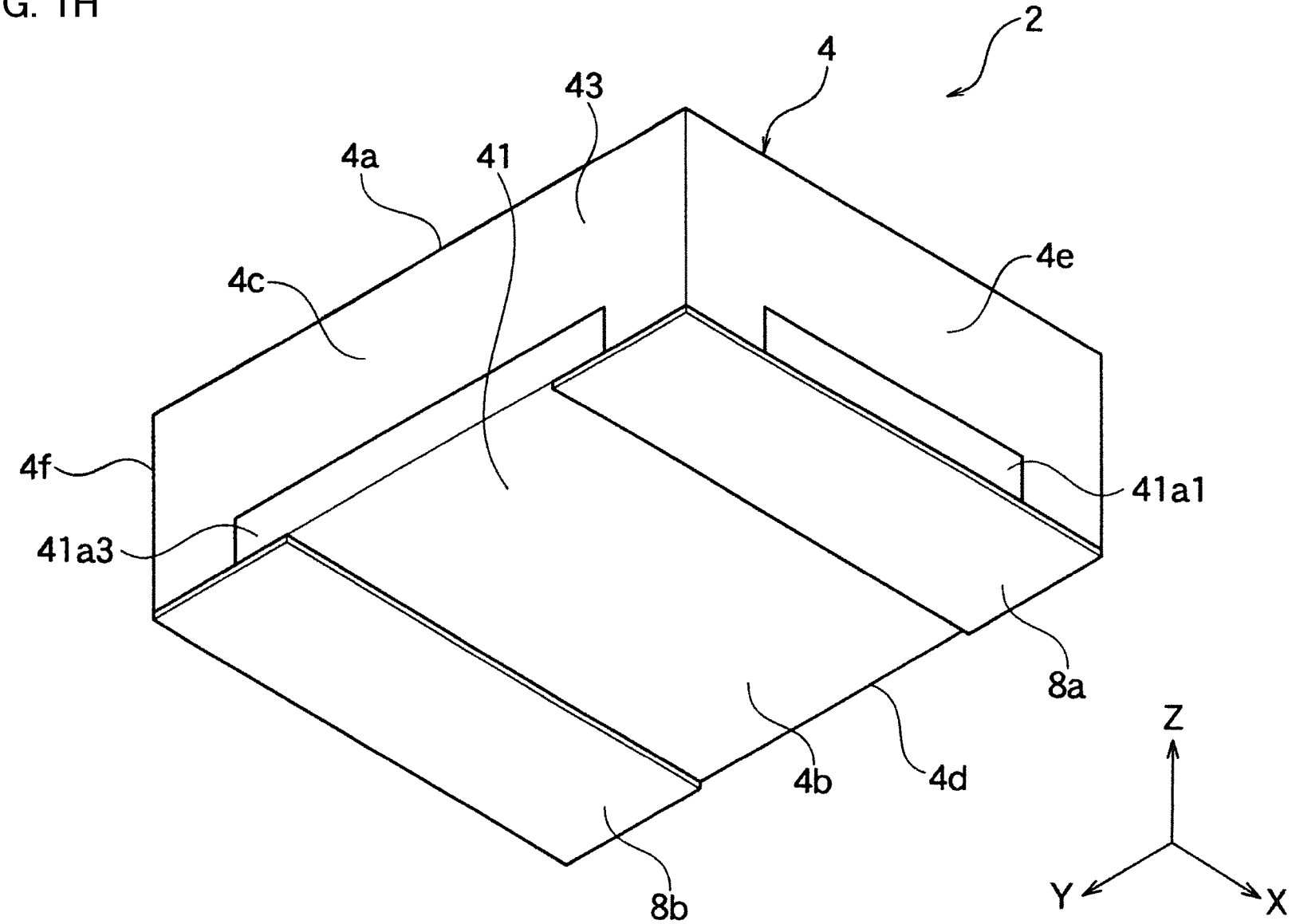
FIG. 1H is a perspective view of the coil device in FIG. 1A that is seen from a mounting surface side.

As illustrated in FIGS. 1A and 1H, a first terminal electrode 8*a* is formed on one X-axis-direction end side (the side surface 4*e* side) of the bottom surface 4*b* of the element body 4 so as to straddle the first core member 41 and the third core member 43. A second terminal electrode 8*b* is formed on the other X-axis-direction end side (the side surface 4*f* side) of the bottom surface 4*b* so as to straddle the first core member 41 and the third core member 43.

In the present embodiment, the first terminal electrode 8*a* may be formed only on the bottom surface 4*b* without straddling the side surfaces 4*c* to 4*e* of the element body 4. The first terminal electrode 8*a* has an elongated shape in the Y-axis direction and provides covering from one Y-axis-direction end of the bottom surface 4*b* on the side surface 4*c* side to the other Y-axis-direction end of the bottom surface 4*b* on the side surface 4*d* side. As illustrated in FIG. 1B, the first terminal electrode 8*a* covers a part (the exposed portion) of the outer peripheral surface of the first lead portion 6α exposed from the bottom surface 4*b* and is electrically connected to the first lead portion 6*a*.

Likewise, the second terminal electrode 8*b* may be formed only on the bottom surface 4*b* without straddling the side surfaces 4*c*, 4*d*, and 4*f* of the element body 4. The second terminal electrode 8*b* has an elongated shape in the Y-axis direction and provides covering from one Y-axis-direction end of the bottom surface 4*b* on the side surface 4*c* side to the other Y-axis-direction end of the bottom surface 4*b* on the side surface 4*d* side. The second terminal electrode 8*b* covers a part (the exposed portion) of the outer peripheral surface of the second lead portion 6*b* exposed from the bottom surface 4*b* and is electrically connected to the second lead portion 6*b*.

The terminal electrodes 8*a* and 8*b* are constituted by, for example, a stacked electrode film of a base electrode film and a plating film. A conductive paste film containing a metal such as Sn, Ag, Ni, and Cu or an alloy of the metals constitutes the base electrode film. The plating film may be formed on the base electrode film. In this case, drying treatment or heat treatment is performed after the base electrode film is formed, and then the plating film is formed. Examples of the plating film include a metal such as Sn, Au, Ni, Pt, Ag, and Pd or an alloy of the metals. It should be noted that the terminal electrodes 8*a* and 8*b* may be formed by sputtering. Preferably, the terminal electrodes 8*a* and 8*b* have a thickness of 3 to 100 μm.

Next, a method for manufacturing the inductor 2 of the present embodiment will be described. Prepared first by the method of the present embodiment are a first core member molded body 410 corresponding to the first core member 41 described above and illustrated in FIG. 2AA, the second core member 42, and a plurality of the coil portions 6*a* (16 in the present embodiment) illustrated in FIG. 2BA and wound in an air core coil shape.

Figure 2A:
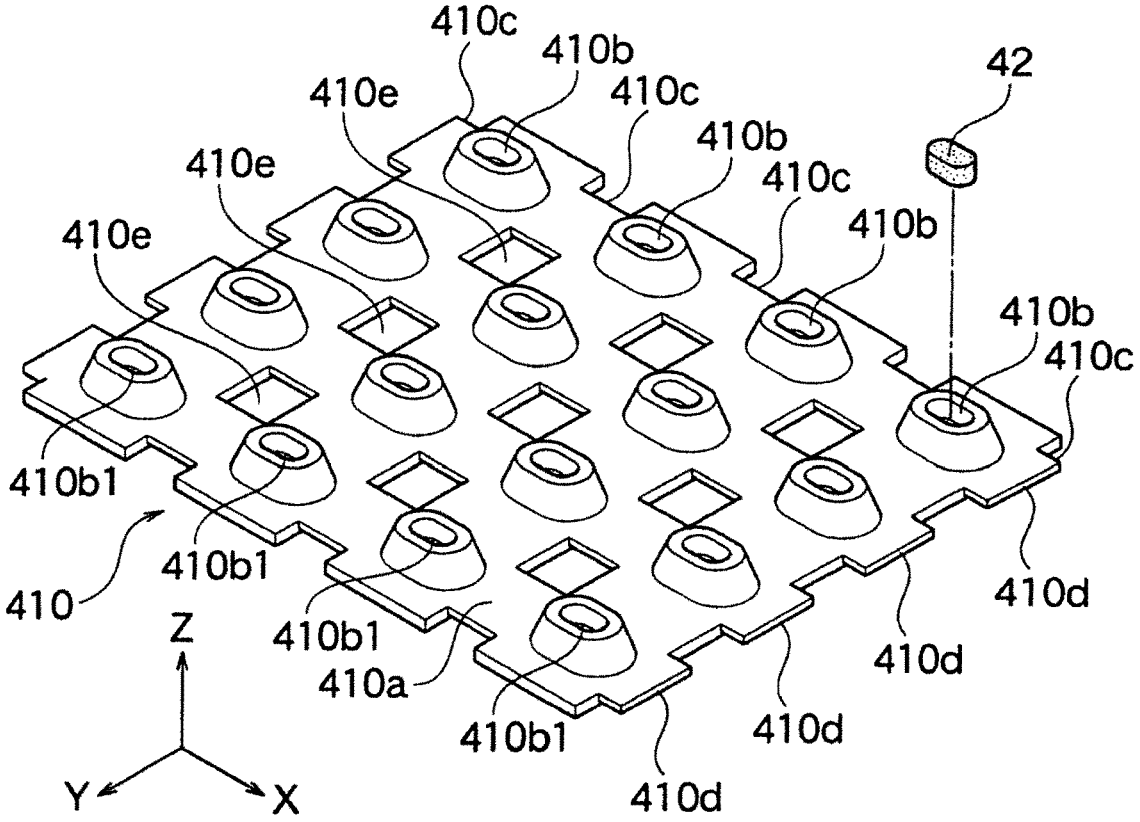
FIG. 2AA and FIG. 2AB are perspective views illustrating a process for manufacturing the coil device.
Figure 2A:
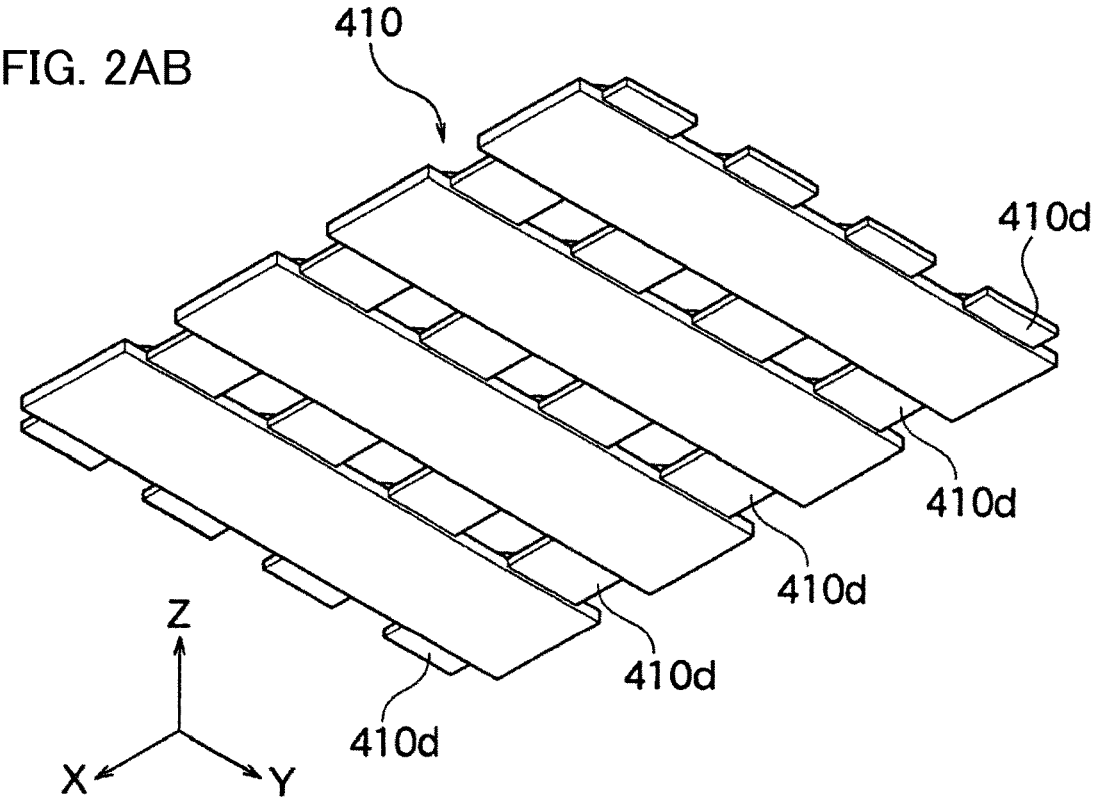

As illustrated in FIG. 2AA, the first core member molded body 410 has a configuration in which a plurality of the above-described first core members 41 (16 in the present embodiment) are connected. The first core member molded body 410 can be obtained by compaction molding, injection molding, scraping processing, or the like. The first core member molded body 410 can be constituted by a material that is high in molding density and magnetic permeability.

The first core member molded body 410 has a support portion 410*a*, a plurality of winding core portions 410*b* (16 in the present embodiment), a plurality of notch portions 410*c* (16 in the present embodiment) formed in the outer periphery of the support portion 410*a*, a plurality of step portions 410*d* (20 in the present embodiment), and a plurality of through holes 410*e* (nine in the present embodiment) formed in the support portion 410*a*. Each winding core portion 410*b* is provided with a recessed portion 410*b*1 so that the second core member 42 is accommodated in the recessed portion 410*b*1.

The support portion 410*a* has a configuration in which the above-described support portion 41*a* is connected. The notch portion 410*c* and a through hole 41*e* are used as passages for the resin that constitutes a third core member 430 to flow as described later. The step portion 410*d* illustrated in FIG. 2AB is used mainly for disposition of the lead portions 6*a* and 6*b* of the coil portion 6α.

The winding core portions 410*b* illustrated in FIG. 2AA are disposed in a lattice shape such that the gap between the winding core portions 410*b* next to each other in the X-axis direction and the gap between the winding core portions 410*b* next to each other in the Y-axis direction are substantially equal to each other. The through holes 410*e* are disposed in a lattice shape such that the gap between the through holes 410*e* next to each other in the X-axis direction and the gap between the through holes 410*e* next to each other in the Y-axis direction are substantially equal to each other.

Figure 2B:
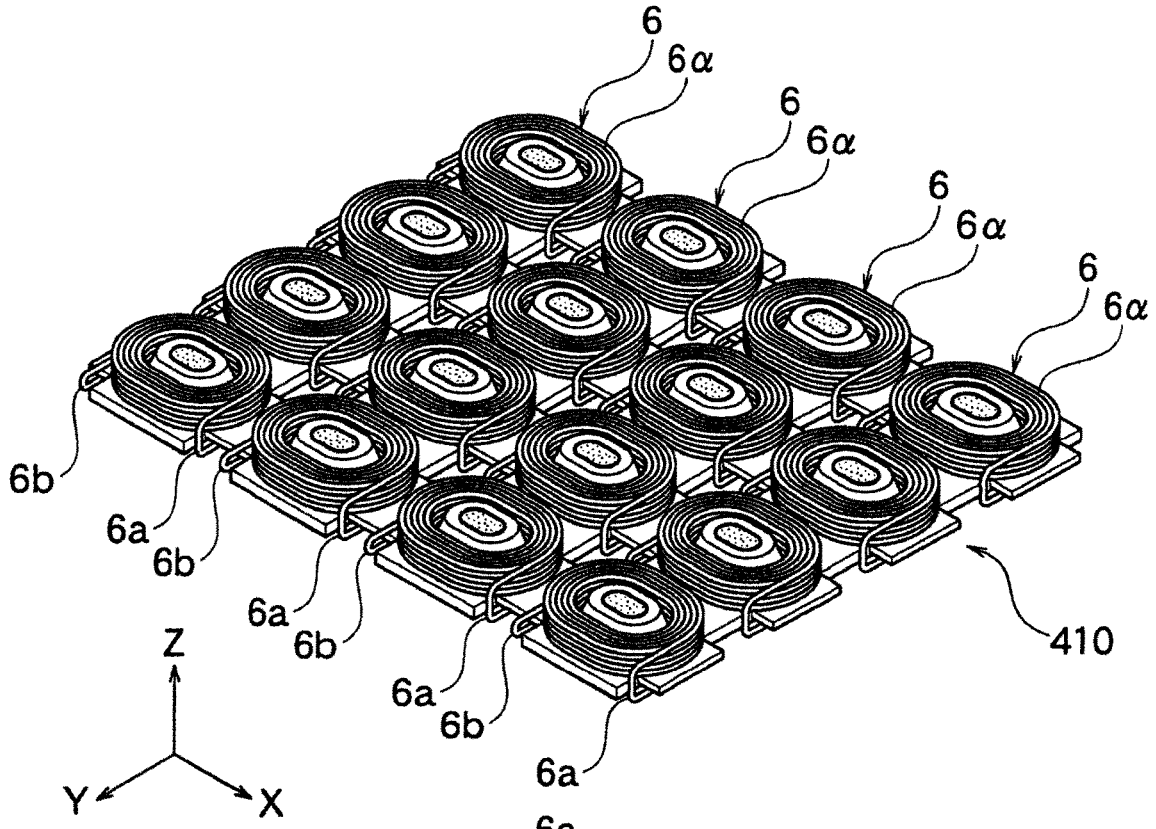
FIG. 2BA and FIG. 2BB are perspective views illustrating the step that is next to FIG. 2AA and FIG. 2AB.
Figure 2B:
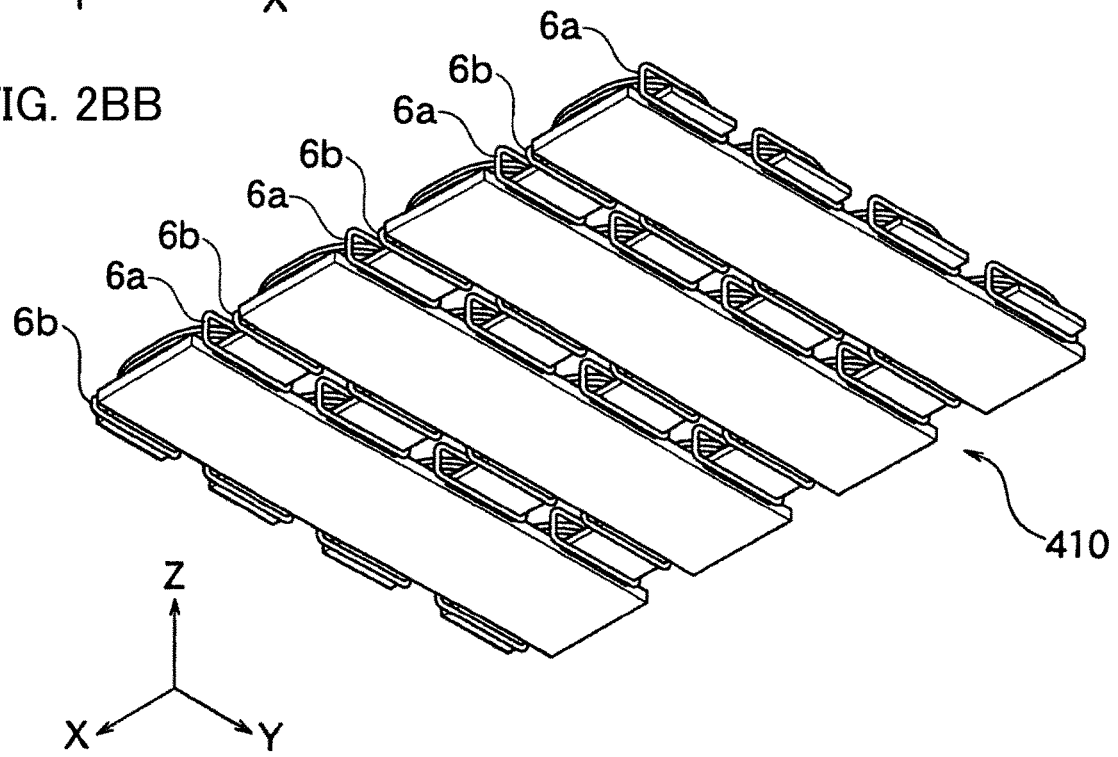

Next, as illustrated in FIG. 2BA, the second core member 42 is accommodated in the recessed portion 410*b*1 of the winding core portion 410*b* (second core member installation step).

Next, the coil portion 6α is provided in the first core member molded body 410 such that the lead portions 6*a* and 6*b* are disposed on the bottom surface (coil installation step). More specifically, as illustrated in FIG. 2BA and FIG. 2BB, the coil portion 6α is disposed in a lattice shape in the support portion 410*a* of the first core member molded body 410 such that the winding core portion 410*b* is positioned in the coil portion 6α. It should be noted that the coil portion 6α may be provided in the support portion 410*a* of the first core member molded body 410 by the wire 6 being wound around the winding core portion 410*b*.

Next, the lead portions 6*a* and 6*b* of the coil portion 6α are oriented so as to be substantially parallel to each other and drawn out by a predetermined distance along the Y-axis direction and are bent in the Z-axis direction and drawn out by a predetermined distance along the Z-axis direction. Further, the lead portions 6*a* and 6*b* are bent in the Y-axis direction, are drawn out by a predetermined distance along the Y-axis direction, and are disposed in the step portion 410*d*. As a result, the lead portions 6*a* and 6*b* partially protrude downward beyond the bottom surface of the support portion 410*a*.

Figure 2C:
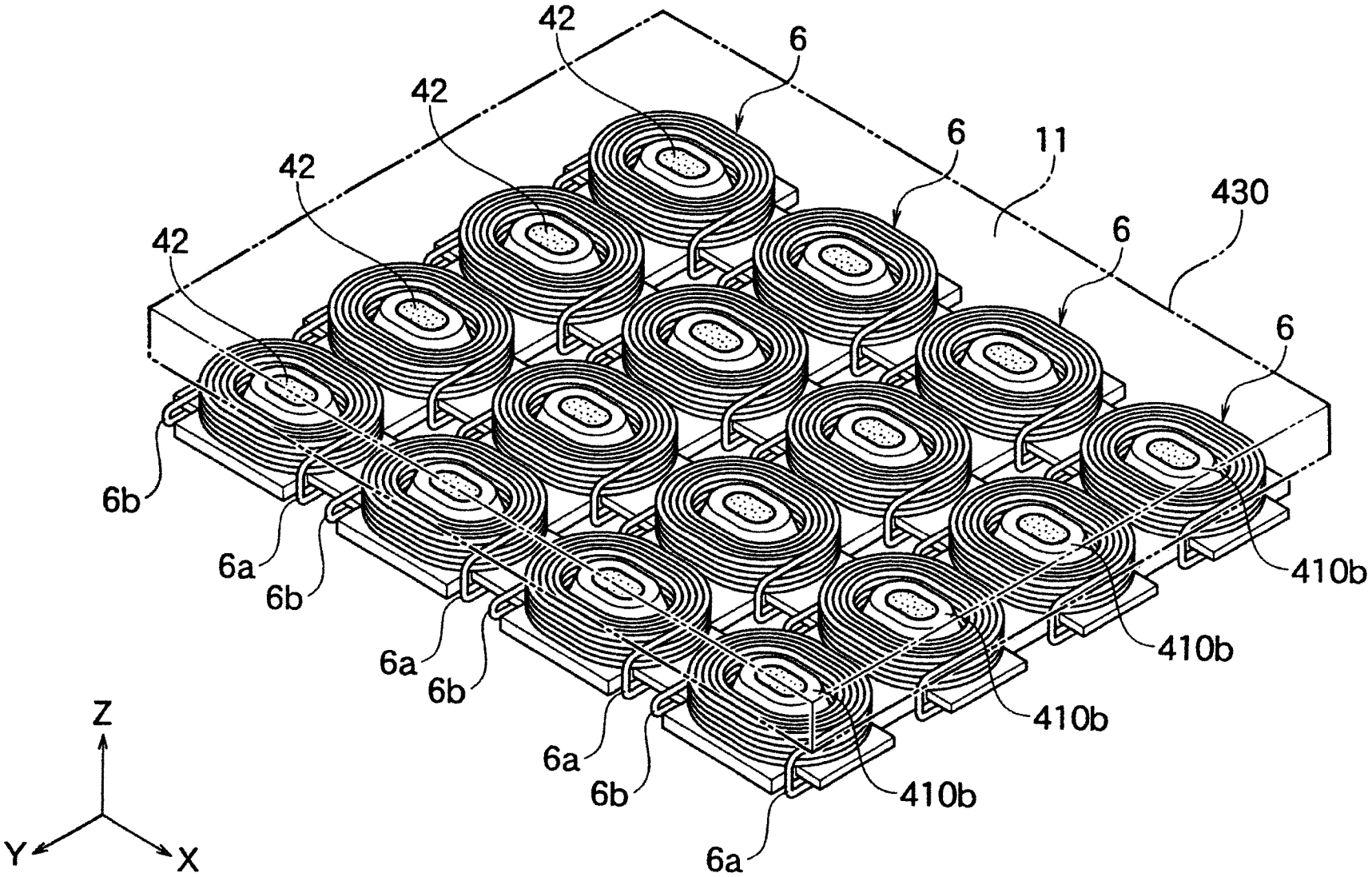
FIG. 2C is a cross-sectional view illustrating the step that is next to FIG. 2BA and FIG. 2BB.

Next, as illustrated in FIG. 2C, the first core member molded body 410 is covered with the third core member 430 such that the outer peripheral surfaces of the lead portions 6*a* and 6*b* are partially exposed (see FIG. 2DA and FIG. 2DB) and a substrate 400 including the first core member molded body 410, the second core member 42, and the third core member 430 is formed (substrate forming step). Methods for molding the third core member 430 are not particularly limited. For example, insert injection molding is used so that molding is performed with the first core member molded body 410 disposed in a press mold. By this molding, the molding material that constitutes the third core member 430 flows from the surface of the first core member molded body 410 to the back surface of the first core member molded body 410 through the notch portion 410*c* or the through hole 410*e* and can be spread into the step portion 410*d*.

A material that has fluidity during molding is used as the material that constitutes the third core member 430, and a composite magnetic material using a thermoplastic resin or a thermosetting resin as a binder is used. The material of the molding press mold is not particularly limited. The material may be appropriately selected from plastic, metals, and the like insofar as the material is capable of withstanding pressure during molding.

Figure 2D:
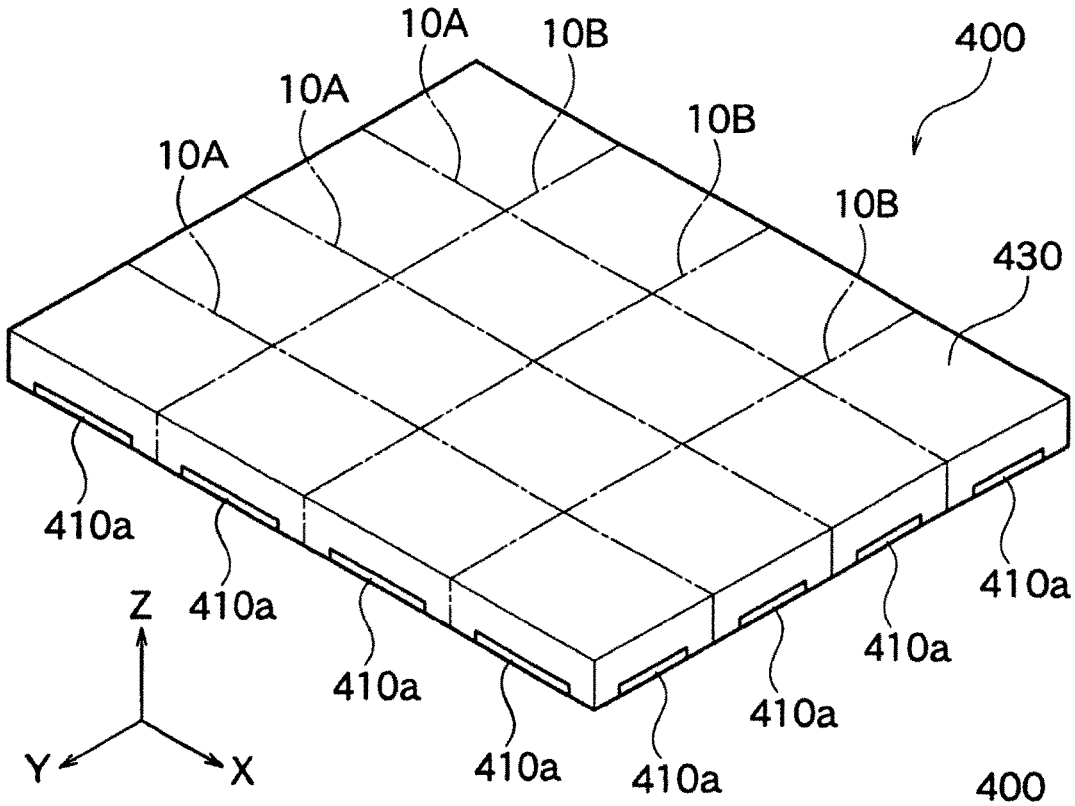
FIG. 2DA and FIG. 2DB are perspective views illustrating the step that is next to FIG. 2C.
Figure 2D:
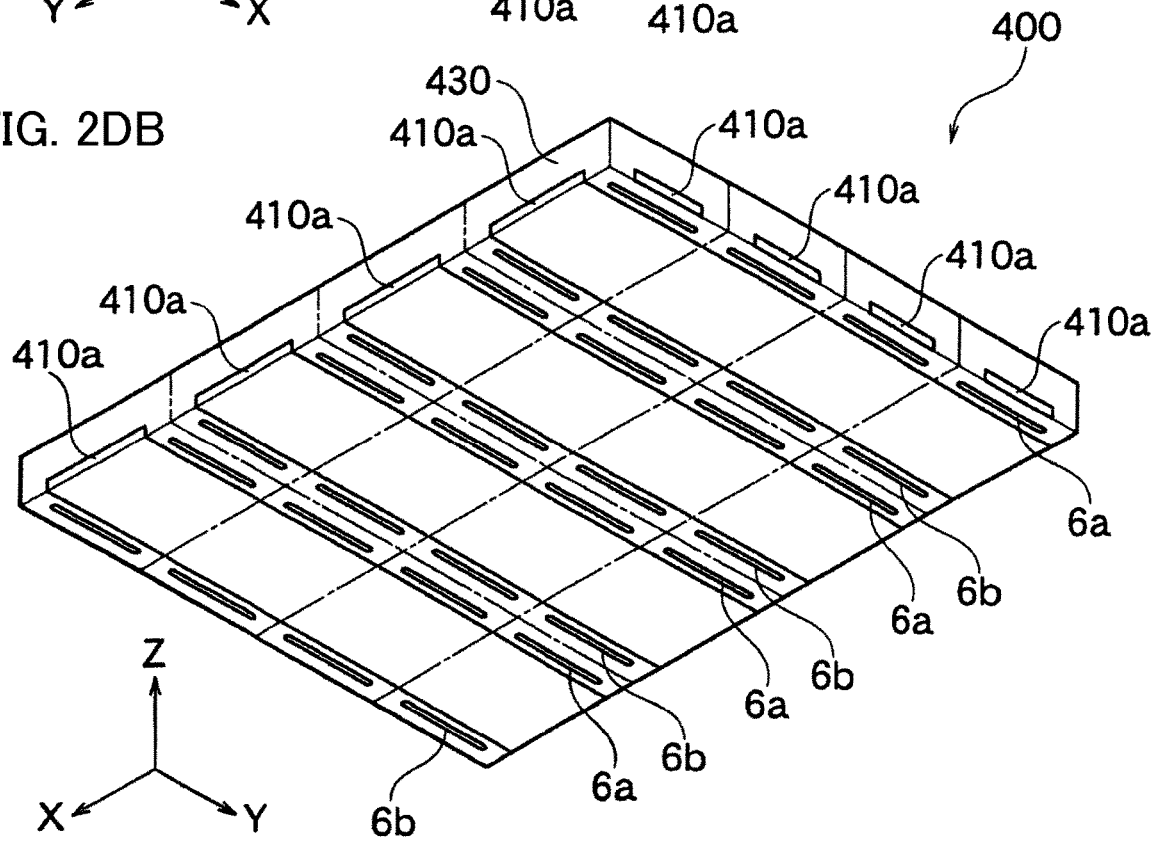

Next, as illustrated in FIG. 2DA and FIG. 2DB, the substrate 400 is cut along a planned cutting line 10A extending in the X-axis direction and a planned cutting line 10B extending in the Y-axis direction. As a result, the substrate 400 is separated into 16 pieces (cutting step). Obtained as a result is the element body 4 in which the single coil portion 6α is embedded as illustrated in FIG. 1A. Methods for cutting the substrate 400 are not particularly limited, and a cutting tool such as a dicing saw and a wire saw, laser cutting, or the like may be used. It should be noted that a dicing saw with a sharp cutting surface is preferably used from the viewpoint of facilitating the cutting.

Next, as illustrated in FIG. 1H, the terminal electrodes 8*a* and 8*b* are formed by a paste method and/or a plating method on the bottom surface 4*b* of the element body 4 in which the wire 6 is embedded, and drying treatment or heat treatment is performed if necessary (terminal electrode forming step). It should be noted that the formation of the terminal electrodes 8*a* and 8*b* is preferably performed by screen printing and by means of sputtering or silver paste. This is because the thin terminal electrodes 8*a* and 8*b* can be formed by the methods.

In the terminal electrode forming step, covering is performed from the side surface 4*c* to the side surface 4*d* of the element body 4 and the terminal electrodes 8*a* and 8*b* are formed on the bottom surface 4*b* of the element body 4 for connection to the respective parts of the outer peripheral surfaces of the lead portions 6*a* and 6*b* of the wire 6 exposed from the bottom surface 4*b* of the element body 4 (bottom surface of the second core member 42).

It should be noted that the terminal electrodes 8*a* and 8*b* provide continuous covering from the intersection of the bottom surface 4*b* and the side surface 4*c* of the element body 4 to the intersection of the bottom surface 4*b* and the side surface 4*d* of the element body 4 in the example that is illustrated in FIG. 1A and the covering may be intermittent instead. In addition, the coatings of the lead portions 6*a* and 6*b* may be removed in advance before the terminal electrode forming step or the cutting step is performed. The removal of the coating can be performed by means of mechanical polishing, a blast, laser heat, or the like.

It should be noted that each step is performed in the order of the cutting step and the terminal electrode forming step after the substrate 400 (molded body) in which the plurality of coil portions 6*a* are embedded is obtained in the manufacturing method described above and the cutting step may be performed after the terminal electrode forming step instead.

In other words, in FIG. 2DA and FIG. 2DB, the element body 4 may be formed by the substrate 400 being cut (cutting step) after the terminal electrode forming step in which a terminal electrode pattern is formed along the Y-axis direction on the bottom surface of the substrate 400 (first core member molded body 410 and third core member 430) for connection to the parts of the outer peripheral surfaces of the lead portions 6*a* and 6*b* exposed from the bottom surface of the third core member 430. By the manufacturing method described above, the production efficiency of the inductor 2 that has the element body 4 where the terminal electrodes 8*a* and 8*b* are formed can be improved.

In addition, in the manufacturing method described above, the cutting step may be performed in advance on the first core member molded body 410 and the second core member installation step, the coil installation step, the substrate forming step, and the terminal electrode forming step may be performed on each cut first core member molded body 410.

With the inductor 2 according to the present embodiment, the effective magnetic permeability of the element body 4 can be increased as, for example, a high-magnetic permeability material such as a metallic magnetic material constitutes the second core member 42. In addition, the first core member 41 and the third core member 43 can be constituted by a rust-resistant magnetic material as the second core member 42 can be constituted by a high-magnetic permeability metallic magnetic material or the like.

In the inductor 2 according to the present embodiment, the second core member 42 is accommodated in the winding core portion 41*b* of the first core member 41, and thus the second core member 42 is separated from the coil portion 6α and the second core member 42 is fixed to the first core member 41 and positioned. Accordingly, contact between the coil portion 6α and the second core member 42, which is constituted by a metallic magnetic material or the like, becomes less likely and short circuit defects can be prevented. In addition, the position of the second core member 42 is unlikely to deviate, the second core member 42 is unlikely to be exposed to the outside of the element body 4, and it is possible to prevent rusting of the surface of the second core member 42 constituted by a metallic magnetic material or the like.

As described above, with the present embodiment, it is possible to increase the effective magnetic permeability of the element body 4 while preventing short circuit defects and rust generation. As a result, it is possible to provide the inductor 2 that is excellent in inductance value and other magnetic properties.

In the inductor 2 according to the present embodiment, the three core members 41, 42, and 43 constitute the element body 4. The three core members 41, 42, and 43 are the first core member 41, the second core member 42, and the third core member 43. Accordingly, it is possible to control the magnetic properties of the inductor 2 with ease and it is possible to constitute the inductor 2 that has various magnetic properties by appropriately selecting the materials constituting the core members 41, 42, and 43.

In the present embodiment, the winding core portion 41*b* has the recessed portion 41*b*1 so that the second core member 42 is accommodated in the recessed portion 41*b*1. As a result of this configuration, the second core member 42 is accommodated in the recessed portion 41*b*1 and the second core member 42 is fixed with ease to the first core member 41. Accordingly, it is possible to prevent a positional deviation of the second core member 42 and effectively enhance the magnetic properties of the inductor 2.

In the present embodiment, the second core member 42 is accommodated in the recessed portion 41*b*1 such that a part of the second core member 42 protrudes outward from the recessed portion 41*b*1. As a result of this configuration, an increase in contact area is achieved among the first core member 41, the second core member 42, and the third core member 43 to the same extent as the protrusion of the second core member 42 to the outside of the recessed portion 41*b*1 and the bondability of each of the core members 41, 42, and 43 is improved. Accordingly, the first core member 41, the second core member 42, and the third core member 43 can be firmly coupled, and it is possible to prevent peeling of the second core member 42 from the third core member 43 and effectively enhance the magnetic properties of the inductor 2.

In the present embodiment, the outer peripheral surface of the winding core portion 41*b* is a tapered surface with a diameter decreasing in a direction away from the bottom surface of the element body 4. As a result of this configuration, the surface area of the outer peripheral surface of the winding core portion 41*b* becomes larger than in a case where, for example, the winding core portion 41*b* has a cylindrical shape, and the contact area between the winding core portion 41*b* (first core member 41) and the third core member 43 increases. Accordingly, the first core member 41 and the third core member 43 can be firmly coupled, and it is possible to prevent peeling of the third core member 43 from the first core member 41 and effectively enhance the magnetic properties of the inductor 2.

When the air core coil-based coil portion 6α is attached to the winding core portion 41*b* of the first core member 41, the coil portion 6α can be easily fitted from the distal end portion of the winding core portion 41*b* toward the proximal end portion of the winding core portion 41*b*. Accordingly, attachment of the coil portion 6α can be performed with ease during manufacturing of the inductor 2.

In the present embodiment, the first core member 41 has the support portion 41*a* that has a surface on which the winding core portion 41*b* is formed and the coil portion 6α is installed on the support portion 41*a*. As a result of this configuration, the coil portion 6α is fixed to the first core member 41 and positioned, and the position of the coil portion 6α is unlikely to deviate. In addition, it is possible to prevent deformation of the coil portion 6α when the third core member 43 covers the first core member 41 in which the second core member 42 is accommodated in the winding core portion 41*b*. As a result of this configuration, it is possible to enhance the magnetic properties of the inductor 2 by preventing a positional deviation, deformation, and so on of the coil portion 6α.

In the present embodiment, each of the first core member 41, the second core member 42, and the third core member 43 contains a magnetic material. As a result of this configuration, it is possible to control the inductance value and the other magnetic properties of the element body 4 in accordance with the type of the magnetic material.

The method for manufacturing the inductor 2 according to the present embodiment includes a step of disposing the first core member 41 having the winding core portion 41*b*, a step of accommodating the second core member 42 in the winding core portion 41*b*, a step of attaching the coil portion 6α made of the wire 6 wound in a coil shape to the winding core portion 41*b*, and a step of covering the first core member 41 with the coil portion 6α by using the third core member 43 with the second core member 42 accommodated in the winding core portion 41*b*.

Accordingly, by the manufacturing method according to the present embodiment, it is possible to easily form the inductor 2 of the present embodiment that has the first core member 41 having the winding core portion 41*b*, the second core member 42 accommodated in the winding core portion 41*b*, and the third core member 43 covering the first core member 41 with the coil portion 6α. Accordingly, with the present embodiment, it is possible to increase the effective magnetic permeability of the element body 4 while preventing short circuit defects and rust generation. As a result, it is possible to provide the inductor 2 that is excellent in inductance value and other magnetic properties.

Second Embodiment

An inductor 2A according to a second embodiment illustrated in FIG. 1C has the same configuration, action, and effect as the inductor 2 according to the first embodiment except the following. Members of the inductor 2A illustrated in FIG. 1C respectively correspond to members of the inductor 2 according to the first embodiment illustrated in FIG. 1B. The corresponding members are given the same reference numerals, and description of the members is partially omitted.

As illustrated in FIG. 1C, the inductor 2A has a second core member 42A. The second core member 42A is constituted by a stacked body of a plurality of sheet-shaped (plate-shaped) magnetic metal plates 421. The thickness of the metal plate 421 is not particularly limited. Preferably, the thickness is 0.05 to 1.0 mm.

With the present embodiment, effects similar to those of the first embodiment can be obtained. In addition, the magnetic properties of the inductor 2A are improved by the magnetic metal plate 421 being used.

It should be noted that FIG. 1C exemplifies a case where the magnetic metal plates 421 are stacked in the Z-axis direction and the stacking direction of the magnetic metal plates 421 is not limited to the exemplification. As illustrated in FIG. 1Q in an alternative example, the plurality of magnetic metal plates 421 having a plate surface parallel to the YZ plane, having a predetermined thickness in the X-axis direction, and having a predetermined height in the Z-axis direction may be stacked (arranged) in the X-axis direction. Alternatively, the plurality of magnetic metal plates 421 having a plate surface parallel to the XZ plane, having a predetermined thickness in the Y-axis direction, and having a predetermined height in the Z-axis direction may be stacked (arranged) in the Y-axis direction.

Third Embodiment

An inductor 2B according to a third embodiment illustrated in FIG. 1D has the same configuration, action, and effect as the inductor 2 according to the first embodiment except the following. Members of the inductor 2B illustrated in FIG. 1D respectively correspond to members of the inductor 2 according to the first embodiment illustrated in FIG. 1B. The corresponding members are given the same reference numerals, and description of the members is partially omitted.

As illustrated in FIG. 1D, the inductor 2B has a second core member 42B. The second core member 42B is constituted by an assemblage of spherical bodies 422 made of spherical magnetic metal balls (such as iron balls). The number of the spherical bodies 422 accommodated in the recessed portion 41*b*1 is not particularly limited, and the number may be one or more. The spherical bodies 422 do not necessarily have to be neatly arranged in the recessed portion 41*b*1 and may be randomly disposed as illustrated in the drawing. In addition, the spherical body 422 does not necessarily have to be perfectly spherical and may have an oval spherical shape.

With the present embodiment, effects similar to those of the second embodiment can be obtained. In addition, eddy current loss reduction can be performed in a more effective manner.

In a case where the plurality of spherical bodies 422 are accommodated in the recessed portion 41*b*1, the second core member 42B has a gap structure due to the gap formed between the plurality of spherical bodies 422. Accordingly, once the third core member 43 covers first core member 41 in which the spherical bodies 422 are accommodated in the winding core portion 41*b*, the gap formed in the recessed portion 41*b*1 is filled with the third core member 43 and a core member made of a mixture of the second core member 42B and the third core member 43 is obtained. Accordingly, it is possible to effectively prevent peeling between the second core member 42B and the third core member 43 and effectively enhance the magnetic properties of the inductor 2.

It should be noted that the invention is not limited to the embodiments described above and can be variously modified within the scope of the invention. For example, although the wire 6 is wound in an elliptical spiral shape in each of the embodiments described above, the shape may be replaced with a circular spiral shape, a rectangular spiral shape, a concentric circular shape, and so on.

An enamel-coated copper wire or silver wire may be used as the wire 6. In addition, the insulation-coated wire may be replaced with a non-insulation-coated wire. The type of the wire is not limited to the round wire, and the wire may be a litz wire, a square wire, or a rectangular wire (flat wire) as illustrated in FIG. 1E. Further, the material of the core wire of the wire is not limited to copper and silver, and the material may be an alloy containing copper and silver, another metal, or another alloy.

In the example that is illustrated in FIG. 1E, a rectangular wire constitutes the wire 6 and the wire 6 is wound edgewise. Alternatively, the wire 6 may be wound normalwise (flatwise) as illustrated in FIG. 1F. In this case, the wire 6 is wound around the second core member 42 in a state where the edge of the wire 6 faces the upper surface 4*a* and the bottom surface 4*b* of the element body 4 unlike in the example that is illustrated in FIG. 1E. After the wire 6 is wound a predetermined number of times, the wire 6 is drawn out along the Y-axis direction toward the side surface 4*c* side of the element body 4 while being twisted such that the edge faces the side surfaces 4*e* and 4*f* of the element body 4. Once the wire 6 (lead ends 6*a* and 6*b*) is twisted by approximately 90 degrees until the edge faces the side surfaces 4*e* and 4*f* of the element body 4, the wire 6 (lead ends 6*a* and 6*b*) is bent in the Z-axis direction and drawn out along the Z-axis direction toward the bottom surface 4*b* of the element body 4 and is bent in the Y-axis direction and drawn out along the Y-axis direction toward the side surface 4*d* of the element body 4.

Figure 3A:
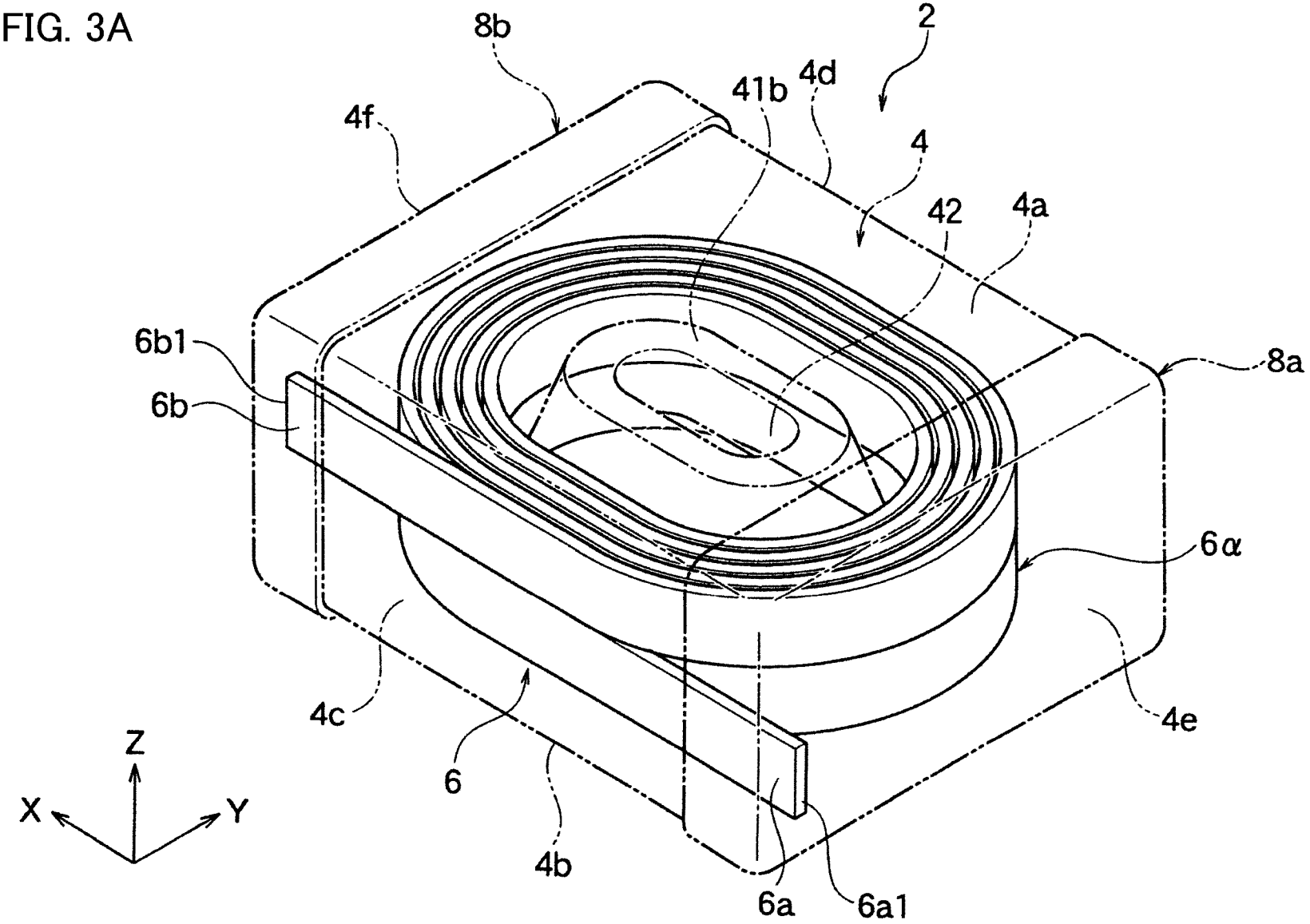
FIG. 3A is a perspective view illustrating a modification example of the coil device illustrated in FIG. 1A.

As illustrated in FIG. 3A, the coil portion 6α that is obtained by a winding of the wire 6 made of a rectangular wire may be formed. In this case, the terminal electrodes 8*a* and 8*b* may be formed on the side surfaces 4*e* and 4*f* of the element body 4 in the terminal electrode forming step described above for connection to end surfaces (connecting wire portions) 6*a*1 and 6*b*1 of the lead portions 6*a* and 6*b* of the wire 6 exposed from the side surfaces 4*e* and 4*f* of the element body 4.

Figure 3B:
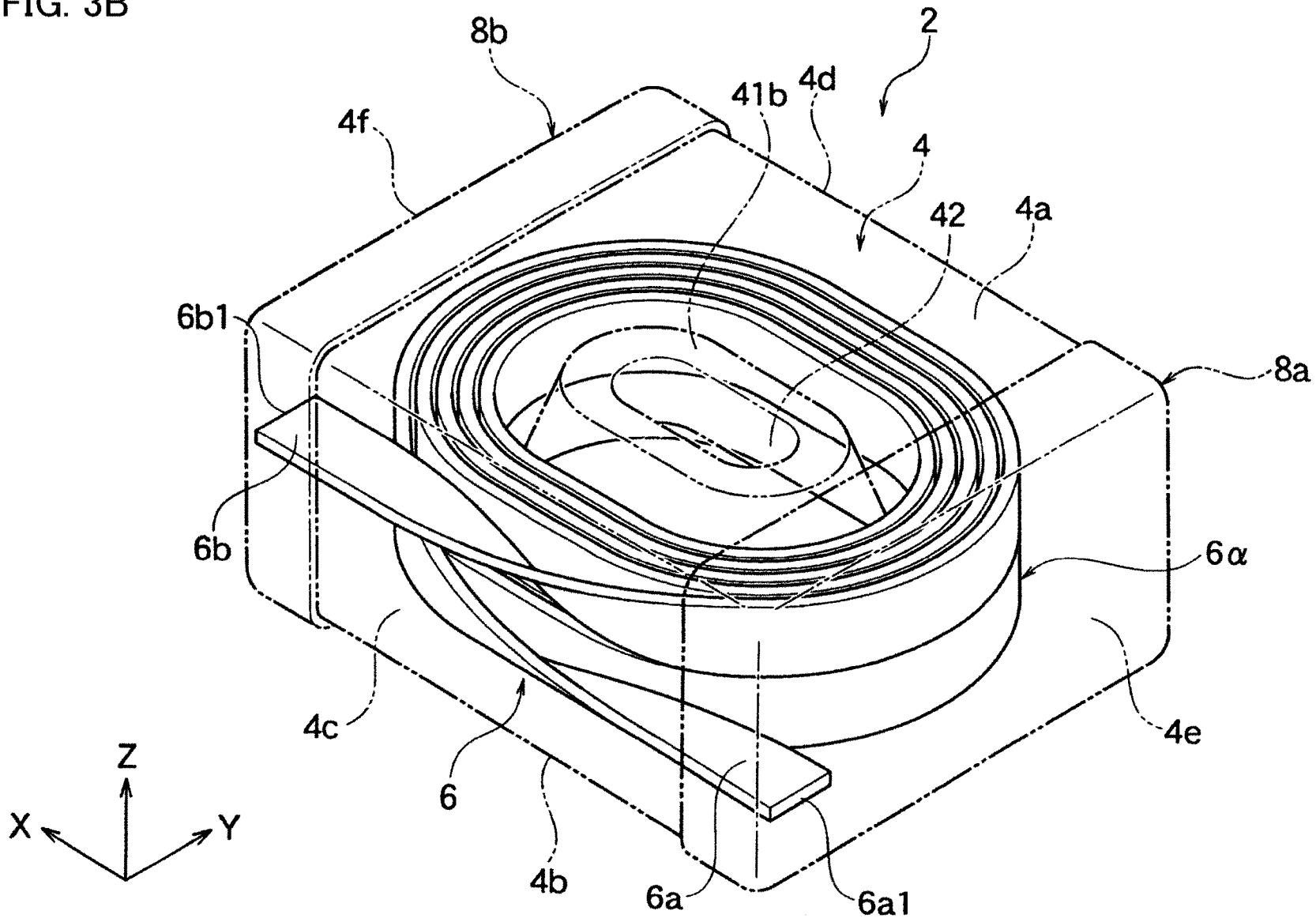
FIG. 3B is a perspective view illustrating a modification example of the coil device illustrated in FIG. 3A.

As illustrated in FIG. 3B, a predetermined amount (predetermined angle) of twisting may be applied to the lead portions 6*a* and 6*b* of the wire 6 made of the rectangular wire. In this case, the end surfaces 6*a*1 and 6*b*1 of the lead portions 6*a* and 6*b* are connected to the side surfaces 4*e* and 4*f* of the element body 4 in a state where the longitudinal direction of the end surfaces 6*a*1 and 6*b*1 is inclined by a predetermined angle (approximately 90 degrees in the illustrated example) with respect to the example that is illustrated in FIG. 3A. In other words, the longitudinal direction of the end surfaces 6*a*1 and 6*b*1 of the lead portions 6*a* and 6*b* faces a substantially horizontal direction with respect to the bottom surface 4*b* of the element body 4 in the example that is illustrated in FIG. 3B whereas the longitudinal direction of the end surfaces 6*a*1 and 6*b*1 of the lead portions 6*a* and 6*b* faces a substantially vertical direction with respect to the bottom surface 4*b* of the element body 4 in the example that is illustrated in FIG. 3A. The surface (side surface) of the lead portions 6*a* and 6*b* of the wire 6 that extends in parallel to the extending direction is not exposed from the side surface 4*c* of the element body 4.

In the example that is illustrated in FIG. 3B, the lead portions 6*a* and 6*b* of the wire 6 are twisted such that the end surfaces 6*a*1 and 6*b*1 are inclined by approximately 90 degrees as compared with the example that is illustrated in FIG. 3A. The inclination angle may be greater or less than 90 degrees.

An insulation-coated wire is preferably used as the wire 6. This is because the wire core wire and the metallic magnetic material powder of the element body 4 are unlikely to be short-circuited even when metallic magnetic material powder is dispersed in the main component that constitutes the element body 4, withstand voltage characteristics are improved, and the insulation-coated wire contributes to inductance deterioration prevention.

In each of the embodiments described above, the first core member 41, the second core member 42, and the third core member 43 do not necessarily have to contain a magnetic material without exception. At least one of the first core member 41, the second core member 42, and the third core member 43 may contain a nonmagnetic material.

In each of the embodiments described above, a sheet-shaped member may constitute, for example, the third core member 430. In this case, the third core member 430 constituted by the sheet-shaped member covers the first core member molded body 410 from above after the coil installation step and the first core member molded body 410 and the third core member 430 are pressure-molded. As a result, it is possible to form the substrate 400 that includes the first core member molded body 410, the second core member 42, and the third core member 430 (substrate forming step).

In each of the embodiments described above, a nonmagnetic material may constitute the second core member 42 alone. By constituting the second core member 42 with a nonmagnetic material, it is possible to adjust the distribution capacitance of the inductor 2 and control the magnetic properties such as the inductance value.

In each of the embodiments described above, the recessed portion 41*b*1 is elliptical when viewed from above in the Z-axis direction. The shape of the recessed portion 41*b*1 is not limited to the elliptical shape. For example, the recessed portion 41*b*1 may have a circular shape, a quadrangular shape, a rectangular shape, or another polygonal shape when viewed from above in the Z-axis direction.

What is claimed is:

1. A coil device comprising:

a coil portion made of a wire wound in a coil shape; and an element body having the coil portion in the element body, wherein the element body includes:

a first core member having a winding core portion configured to be positioned inside the coil portion and having a recessed portion;

a second core member accommodated in the recessed portion; and a third core member covering the coil portion and the first core member in which the second core member is accommodated in the recessed portion, wherein the second core member is formed separately from both the first core member and the third core member, and the third core member has a filling portion disposed outside the winding core portion and formed between the winding core portion and the coil portion.

2. The coil device according to claim 1, wherein the second core member is accommodated in the recessed portion such that a part of the second core member protrudes outward from the recessed portion.

3. The coil device according to claim 1, wherein an outer peripheral surface of the winding core portion is a tapered surface with a diameter decreasing in a direction away from a bottom surface of the element body.

4. The coil device according to claim 2, wherein an outer peripheral surface of the winding core portion is a tapered surface with a diameter decreasing in a direction away from a bottom surface of the element body.

5. The coil device according to claim 1, wherein the first core member has a support portion having a surface on which the winding core portion is formed, and the coil portion is installed on the support portion.

6. The coil device according to claim 2, wherein the first core member has a support portion having a surface on which the winding core portion is formed, and the coil portion is installed on the support portion.

7. The coil device according to claim 1, wherein at least one of the first core member, the second core member, and the third core member contains a magnetic material.

8. The coil device according to claim 2, wherein at least one of the first core member, the second core member, and the third core member contains a magnetic material.

9. A coil device comprising:

a coil portion made of a wire wound in a coil shape;

an element body having the coil portion in the element body; and terminal electrodes disposed on a mounting surface of the element body, wherein the element body includes:

a first core member having a winding core portion configured to be positioned inside the coil portion and having a recessed portion;

a second core member accommodated in the recessed portion; and a third core member covering the coil portion and the first core member in which the second core member is accommodated in the recessed portion, wherein the recessed portion is opened toward a side opposite to the mounting surface of the element body, and is formed so that the second core member is inserted from the side opposite to the mounting surface of the element body, and the third core member has a filling portion disposed outside the winding core portion and formed between the winding core portion and the coil portion.

* * * * *